US009002489B2

(12) United States Patent
Toyama et al.

(10) Patent No.: US 9,002,489 B2
(45) Date of Patent: Apr. 7, 2015

(54) SIGNAL PROCESSING APPARATUS, SIGNAL PROCESSING METHOD, AND PROGRAM

(75) Inventors: Keisuke Toyama, Tokyo (JP); Mototsugu Abe, Kanagawa (JP)

(73) Assignee: Sony Corporation, Tokyo (JP)

( * ) Notice: Subject to any disclaimer, the term of this patent is extended or adjusted under 35 U.S.C. 154(b) by 741 days.

(21) Appl. No.: 13/079,057

(22) Filed: Apr. 4, 2011

(65) Prior Publication Data

US 2011/0255710 A1 Oct. 20, 2011

(30) Foreign Application Priority Data

Apr. 14, 2010 (JP) ..... P2010-092817
Aug. 4, 2010 (JP) ..... P2010-175335

(51) Int. Cl.

| | |
|---|---|
| ***G06F 17/00*** | (2006.01) |
| ***H04R 29/00*** | (2006.01) |
| ***H04B 15/00*** | (2006.01) |
| ***H04R 3/00*** | (2006.01) |

(52) U.S. Cl.
CPC ..... *H04R 3/007* (2013.01)

(58) Field of Classification Search
CPC ..... G11B 2020/10555; H03G 11/00; H03G 9/025
USPC ..... 700/94; 381/71.1, 94.4, 119, 55, 56, 381/94.8
See application file for complete search history.

(56) References Cited

FOREIGN PATENT DOCUMENTS

| | | |
|---|---|---|
| JP | 7-105692 | 11/1995 |
| JP | 2702446 | 10/1997 |
| JP | 3420831 | 4/2003 |

*Primary Examiner* — Xu Mei
*Assistant Examiner* — Douglas Suthers
(74) *Attorney, Agent, or Firm* — Hazuki International, LLC

(57) ABSTRACT

A signal processing apparatus includes an absolute value unit configured to convert an audio signal into absolute values, a representative value calculation unit configured to calculate representative values of consecutive sample values included in blocks of the audio signal which has been converted into the absolute values using at least maximum sample values among values of the samples included in the blocks for individual blocks, an average value calculation unit configured to determine a section which includes a predetermined number of consecutive blocks as a frame and calculate a maximum value of the representative values of the blocks included in the frame and an average value of the representative values of the blocks included in the frame, and a detector configured to detect click noise in the frame on the basis of a ratio of the maximum value to the average value.

15 Claims, 17 Drawing Sheets

SIGNAL PROCESSING APPARATUS, SIGNAL PROCESSING METHOD, AND PROGRAM

BACKGROUND OF THE INVENTION

1. Field of the Invention

The present invention relates to signal processing apparatuses, signal processing methods, and programs, and particularly relates to a signal processing apparatus capable of more easily and more reliably detecting noise, a signal processing method, and a program.

2. Description of the Related Art

In apparatuses which collect sound using incorporated microphones such as IC recorders, for example, it is likely that noise referred to as "touch noise" is generated since users touch the apparatuses when sound is collected.

In particular, click noise is generated due to energy integrated within a short period of time when various functional switches are clicked during recording and is output as abnormal noise which is not masked by other sounds at a time of reproduction of the collected sound and which is offensive to the ear. Therefore, there is a demand for a technique of detecting and reducing such click noise.

As a method for reducing click noise, a method for performing filter processing on a signal to be processed using a high-pass filter and detecting click noise using a ratio of a maximum value to a movement average value (refer to Japanese Examined Patent Application Publication No. 7-105692, for example) and a method for detecting click noise using a difference between a maximum value and a minimum value in a frame (refer to Japanese Patent No. 3420831, for example) have been proposed.

However, in these methods, if the signal to be processed includes a portion corresponding to high energy and a portion corresponding to low energy, not only click noise but also music, voice (especially, consonant), and the like may be detected as click noise. For example, a signal having high energy level for a certain period may be detected as the click noise.

Therefore, a method for detecting a persistence length of a pulse signal and determining that the signal is not click noise but a music signal when the persistence length is equal to or larger than a certain length has been proposed (refer to Japanese Patent No. 2702446, for example).

SUMMARY OF THE INVENTION

However, in the method for detecting a persistence length, a high-pass filter and a low-pass filter are used for detecting click noise, and in addition, the low-pass filter has to have a relatively steep characteristic. Accordingly, a calculation amount inevitably becomes large.

It is desirable to more easily and more reliably detect noise.

According to an embodiment of the present invention, there is provided a signal processing apparatus including absolute value means for converting an audio signal into absolute values, representative value calculation means for calculating representative values of consecutive sample values included in blocks of the audio signal which has been converted into the absolute values using at least maximum sample values among values of the samples included in the blocks for individual blocks, average value calculation means for determining a section which includes a predetermined number of consecutive blocks as a frame and calculating a maximum value of the representative values of the blocks included in the frame and an average value of the representative values of the blocks included in the frame, and detection means for detecting click noise in the frame on the basis of a ratio of the maximum value to the average value.

The representative value calculation means may determine that maximum sample values among the values of the samples included in the blocks correspond to the representative values for individual blocks.

The detection means may determine that the frame includes the click noise when the ratio of the maximum value to the average value is equal to or larger than a predetermined threshold value.

The detection means may detect the click noise in the frame to be processed using the maximum value and the average value of the frame to be processed and maximum values and average values of other frames located in the vicinity of the frame to be processed.

The signal processing apparatus may further include past interpolation waveform generation means for generating a past interpolation waveform to be used for interpolation of a noise section including the click noise using a first waveform of a section of the audio signal which has the same length as the noise section and which is located on a past side relative to the noise section of the audio signal, future interpolation waveform generation means for generating a future interpolation waveform to be used for the interpolation of the noise section using a second waveform of a section of the audio signal which has the same length as the noise section and which is located on a future side relative to the noise section of the audio signal, interpolation waveform generation means for generating an interpolation waveform by cross-fade using the past interpolation waveform and the future interpolation waveform, and replacing means for reducing the click noise by replacing the noise section of the audio signal by the interpolation waveform.

The signal processing apparatus may further include noise section detection means for determining, when the click noise is detected in the frame to be processed, that a noise starting block corresponds to one of the blocks which has a representative value equal to or smaller than a threshold value which is one of representative values of a frame located immediately before the frame to be processed and which is located, on the past side, in a nearest position relative to one of the blocks which has the maximum representative value of the frame to be processed, and for detecting a position of one of the samples which performs zero-cross first and which is located on the past side relative to a last sample included in the noise starting block.

The signal processing apparatus may further include noise section detection means for determining, when the click noise is detected in the frame to be processed, that a noise terminating clock corresponds to one of the blocks which has a representative value equal to or smaller than a threshold value corresponding to one of representative values of a frame located immediately after the frame to be processed and which is located, on the future side, in a nearest position relative to one of the blocks which has the maximum representative value of the frame to be processed, and for detecting a position of one of the samples which performs zero-cross first and which is located on the future side relative to a leading sample included in the noise terminating block.

The past interpolation waveform generation means may generate the past interpolation waveform by performing time reversal on the first waveform of the section of the audio signal which has the same length as the noise section and which is located adjacent to the noise section on the past side. The future interpolation waveform generation means may generate the future interpolation waveform by performing the time reversal on the second waveform of the section of the audio signal which has the same length as the noise section and which is located adjacent to the noise section on a future side.

The past interpolation waveform generation means may generate the past interpolation waveform by performing the time reversal on the first waveform and inverting signs of values of samples located before and after an end sample of the noise section on the past side when the signs of the signs of the values of the samples are different from each other. The future interpolation waveform generation means generates the future interpolation waveform by performing the time reversal on the second waveform and inverting signs of values of samples located before and after an end sample of the noise section on the future side when the signs of the signs of the values of the samples are different from each other.

The signal processing apparatus may further include noise section detection means for determining, when the click noise is detected in the frame to be processed, that a starting position of the click noise corresponds to a position of a leading sample of one of the blocks which has a representative value equal to or smaller than a threshold value corresponding to one of representative values of a frame located immediately before the frame to be processed and which is located, on the past side, in a nearest position relative to one of the blocks which has the maximum representative value of the frame to be processed.

The signal processing apparatus may further include noise section detection means for determining, when the click noise is detected in the frame to be processed, that a terminating position of the click noise corresponds to a position of a last sample of one of the blocks which has a representative value equal to or smaller than a threshold value corresponding to one of representative values of a frame located immediately after the frame to be processed and which is located, on the past side, in a nearest position relative to one of the blocks which has the maximum representative value of the frame to be processed.

The replacing means may generate an adjacent interpolation waveform by performing cross-fade using a waveform of a section which has a predetermined length and which is located immediately before the noise section of the audio signal and a waveform of a section which has a predetermined length and which is located immediately before the section corresponding to the first waveform of the audio signal, and replace the adjacent section by the adjacent interpolation waveform.

The replacing means may generate an adjacent interpolation waveform by performing cross-fade using a waveform of a section which has a predetermined length and which is located immediately after the noise section of the audio signal and a waveform of a section which has a predetermined length and which is located immediately after the section corresponding to the second waveform of the audio signal, and replace the adjacent section by the adjacent interpolation waveform.

According to another embodiment of the present invention, there is provided a signal processing method including the steps of converting an audio signal into absolute values, calculating representative values of consecutive sample values included in blocks of the audio signal which has been converted into the absolute values using at least maximum sample values among values of the samples included in the blocks for individual blocks, determining a section which includes a predetermined number of consecutive blocks as a frame and calculating a maximum value of the representative values of the blocks included in the frame and an average value of the representative values of the blocks included in the frame, and detecting click noise in the frame on the basis of a ratio of the maximum value to the average value.

According to a further embodiment of the present invention, there is provided a program which causes a computer to perform a process including the steps of converting an audio signal into absolute values, calculating representative values of consecutive sample values included in blocks of the audio signal which has been converted into the absolute values using at least maximum sample values among values of the samples included in the blocks for individual blocks, determining a section which includes a predetermined number of consecutive blocks as a frame and calculating a maximum value of the representative values of the blocks included in the frame and an average value of the representative values of the blocks included in the frame, and detecting click noise in the frame on the basis of a ratio of the maximum value to the average value.

Accordingly, noise may be more reliably and more easily detected.

DESCRIPTION OF THE PREFERRED EMBODIMENTS

Embodiments of the present invention will be described hereinafter with reference to the accompanying drawings.

First Embodiment

Configuration of Signal Processing Apparatus

Figure 1:
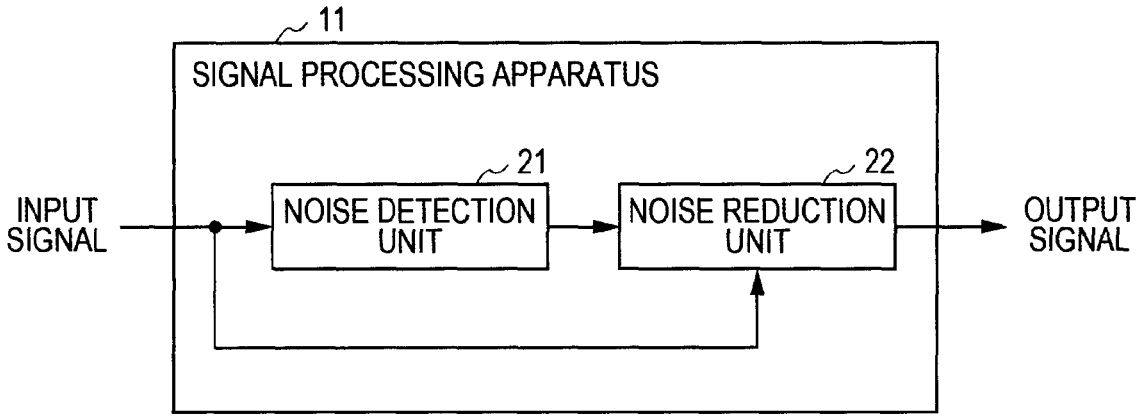
FIG. 1 is a diagram illustrating an example of a configuration of a signal processing apparatus according to an embodiment of the present invention.

FIG. 1 is a diagram illustrating a configuration of a signal processing apparatus according to an embodiment of the present invention.

For example, a signal processing apparatus 11 corresponds to a recording/reproducing apparatus which collects surrounding sound and reproduces the collected sound. To the signal processing apparatus 11, a signal such as a sound signal collected using a microphone or the like is input. The signal processing apparatus 11 detects click noise in the input signal, removes the click noise, and outputs the signal from which the click noise is removed as an output signal.

The signal processing apparatus 11 includes a noise detection unit 21 and a noise reduction unit 22. An input signal is supplied to the noise detection unit 21 and the noise reduction unit 22.

The noise detection unit 21 detects a section including click noise in the input signal and supplies a result of the detection to the noise reduction unit 22. Note that the click noise corresponds to a signal in a short section in a time direction of the signal which includes concentrated larger energy (amplitude) when compared with other surrounding sections.

The noise reduction unit 22 removes the click noise from the input signal where appropriate in accordance with the result of the detection of click noise supplied from the noise detection unit 21 and outputs a resultant signal.

Configuration of Noise Detection Unit

Figure 2:
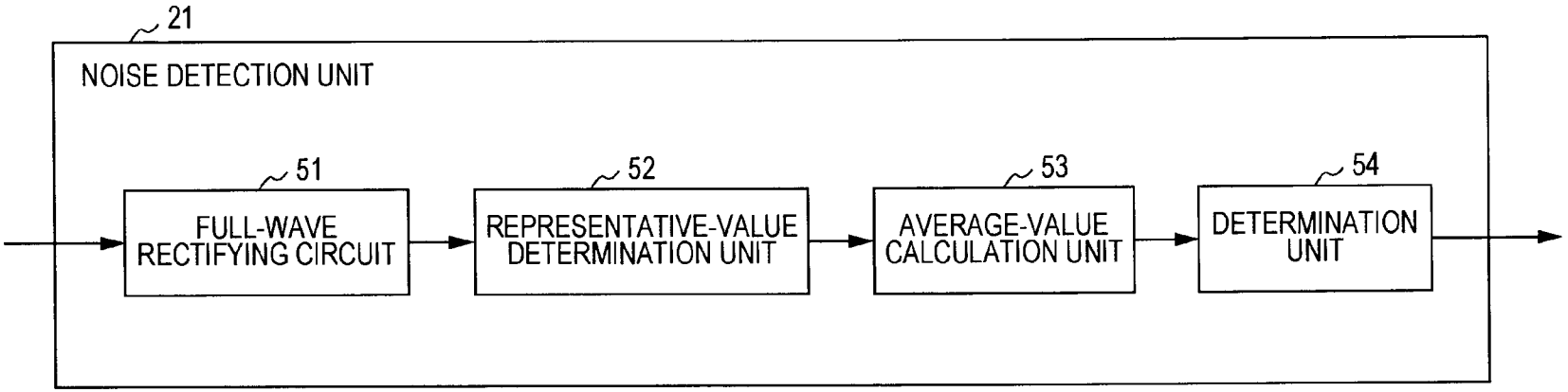
FIG. 2 is a diagram illustrating a configuration of a noise detection unit.

The noise detection unit 21 illustrated in FIG. 1 is configured as illustrated in FIG. 2 in detail. Specifically, the noise detection unit 21 includes a full-wave rectifying circuit 51, a representative-value determination unit 52, an average-value calculation unit 53, and a determination unit 54.

The full-wave rectifying circuit 51 converts the input signal as an absolute value and supplies the absolute value to the representative-value determination unit 52. The representative-value determination unit 52 divides the signal which has been converted into the absolute value and which has been supplied from the full-wave rectifying circuit 51 into blocks corresponding to sections each of which has a predetermined length, calculates representative values of the blocks, and supplies the representative values to the average-value calculation unit 53. For example, a maximum value among values of samples of an input signal included in a block serves as a representative value of the values of the samples of the block.

The average-value calculation unit 53 calculates a maximum value and an average value of consecutive blocks included in a frame using the representative values of the blocks supplied from the representative-value determination unit 52 and supplies the maximum value and the average value to the determination unit 54. The determination unit 54 obtains a ratio of the average value to the maximum value of the frame supplied from the average-value calculation unit 53, determines whether the frame includes click noise in accordance with the ratio, and supplies a result of the determination as a result of detection of click noise to the noise reduction unit 22.

Configuration of Noise Reduction Unit

Figure 3:
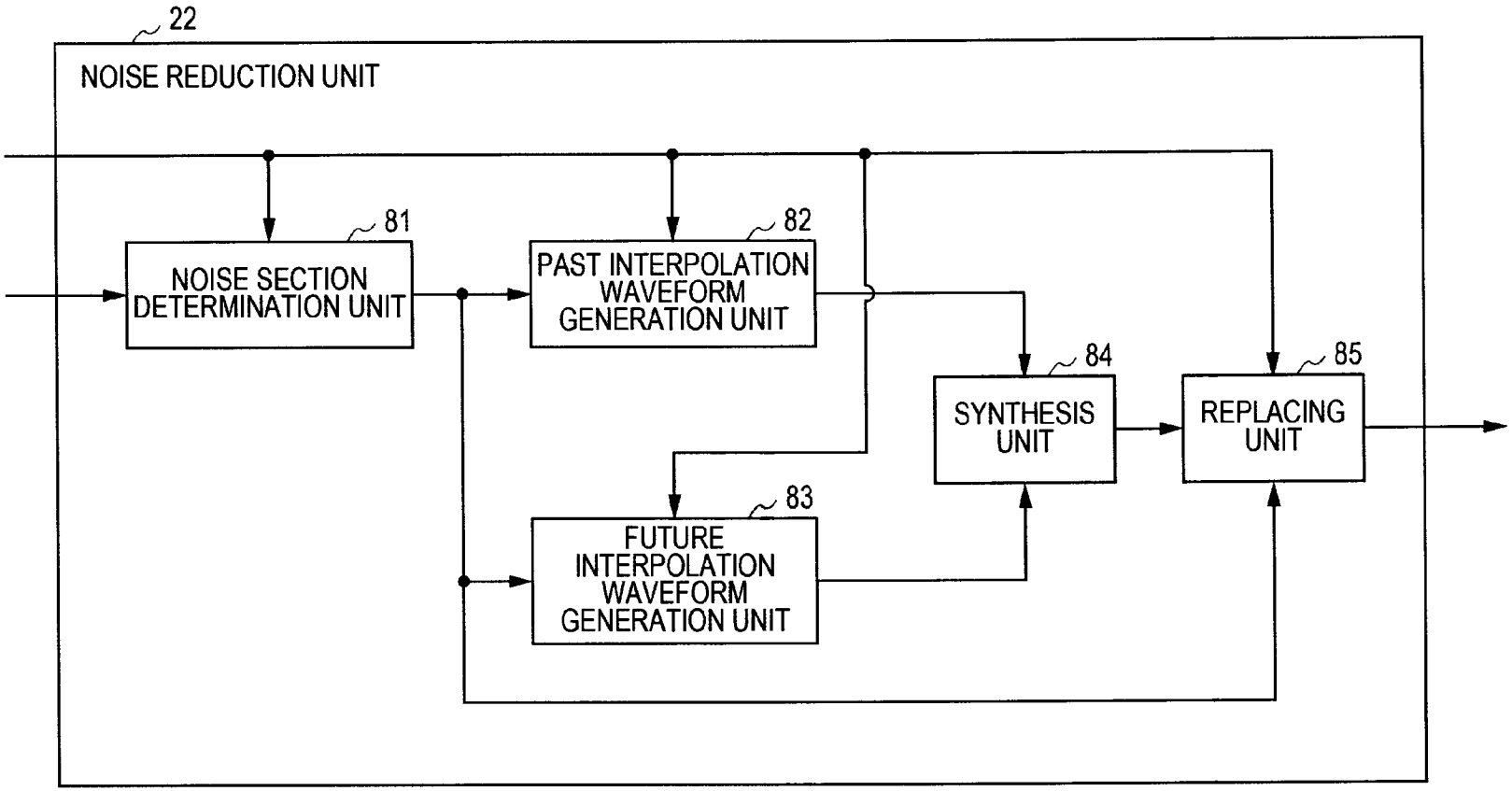
FIG. 3 is a diagram illustrating a configuration of a noise reduction unit.

Furthermore, the noise reduction unit 22 illustrated in FIG. 1 is configured as illustrated in FIG. 3.

Specifically, the noise reduction unit 22 includes a noise section determination unit 81, a past interpolation waveform generation unit 82, a future interpolation waveform generation unit 83, a synthesis unit 84, and a replacing unit 85. In the noise reduction unit 22, the signal is input to the noise section determination unit 81, the past interpolation waveform generation unit 82, the future interpolation waveform generation unit 83, and the replacing unit 85.

The noise section determination unit 81 specifies a section including click noise in the input signal in accordance with the result of the detection of click noise supplied from the determination unit 54 and supplies a result of the specifying to the past interpolation waveform generation unit 82, the future interpolation waveform generation unit 83, and the replacing unit 85. Note that, the section including click noise included in the input signal may be referred to as a "noise section" hereinafter.

The past interpolation waveform generation unit 82 generates a past interpolation waveform used for interpolation of the noise section using a section which is temporally before the noise section included in the input signal in accordance with the result of the specifying supplied from the noise section determination unit 81 and the input signal, and supplies the past interpolation waveform to the synthesis unit 84.

The future interpolation waveform generation unit 83 generates a future interpolation waveform used for interpolation of the noise section using a section which is temporally after the noise section included in the input signal in accordance with the result of the specifying supplied from the noise section determination unit 81 and the input signal, and supplies the future interpolation waveform to the synthesis unit 84.

The synthesis unit 84 synthesizes the past interpolation waveform supplied from the past interpolation waveform generation unit 82 and the future interpolation waveform supplied from the future interpolation waveform generation unit 83, and supplies a resultant interpolation waveform to the replacing unit 85. The replacing unit 85 removes the click noise by replacing the noise section included in the input signal by the interpolation waveform supplied from the synthesis unit 84 using the specifying result supplied from the noise section determination unit 81, and outputs a resultant signal.

Noise Reduction Process

Figure 4:
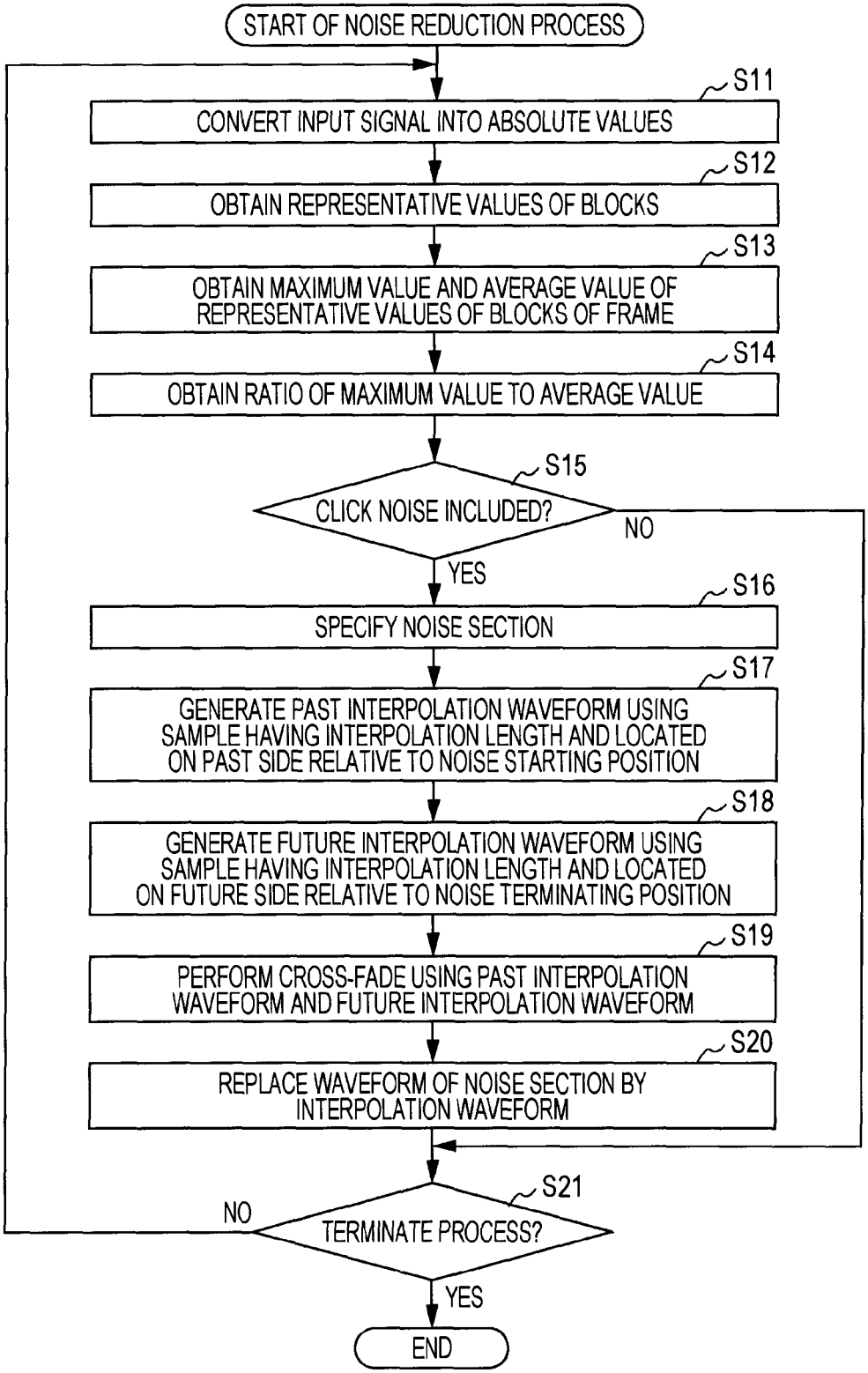
FIG. 4 is a flowchart illustrating a noise reduction process.

Referring now to FIG. 4, a noise reduction process performed by the signal processing apparatus 11 will be described.

In step S11, the full-wave rectifying circuit 51 performs full-wave rectification on an input signal, that is, converts the input signal into absolute values, and supplies resultant values to the representative-value determination unit 52.

Figure 5:
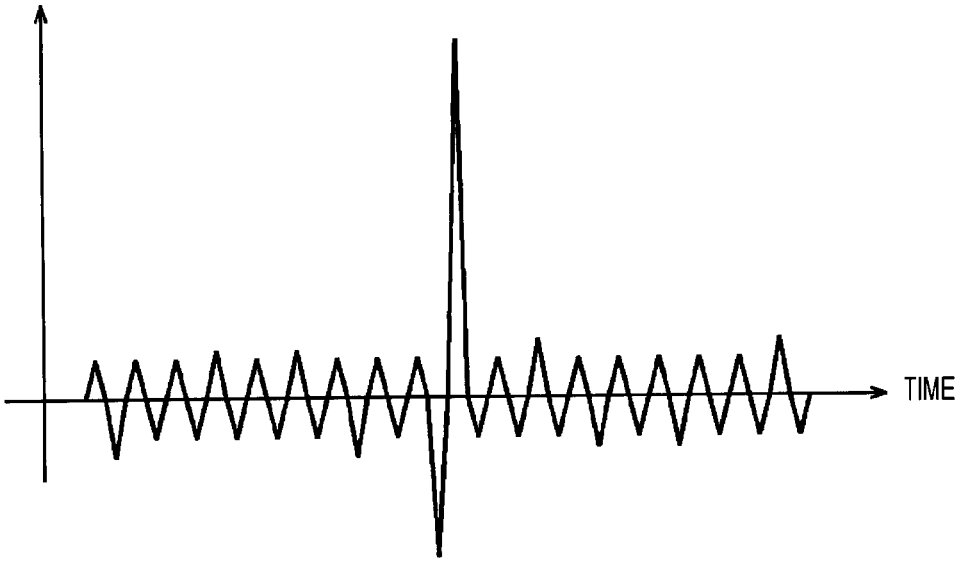
FIG. 5 is a diagram illustrating an input signal.
Figure 5:
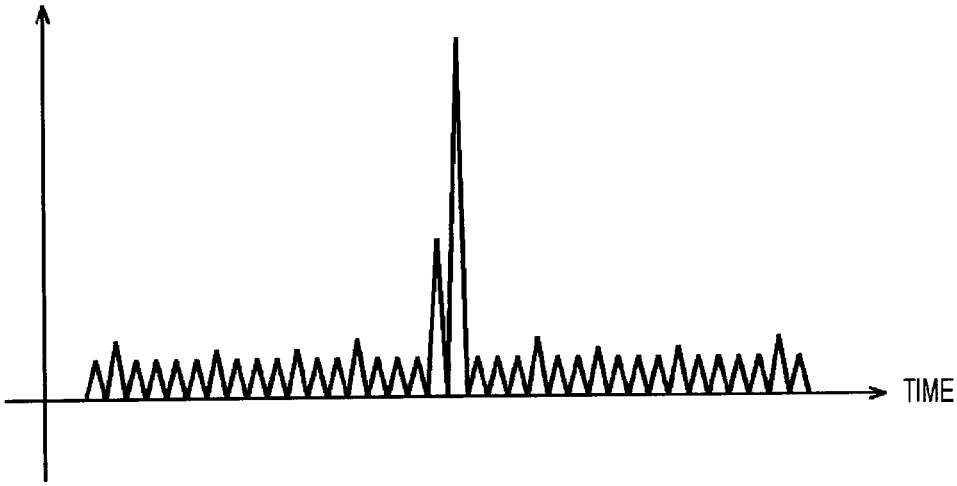

When an input signal having a waveform illustrated in an upper portion in FIG. 5 is supplied, for example, absolute values of values of samples are obtained as illustrated in a lower portion in FIG. 5. The obtained absolute values are newly determined as the values of the samples which have been subjected to the full-wave rectification.

Note that, in FIG. 5, axes of ordinate denote time whereas axes of abscissa denote amplitude. In the example illustrated in FIG. 5, a sample value, i.e., amplitude (energy), of a sample located in the vicinity of a center of the input signal is considerably projected when compared with values of other surrounding samples. That is, the amplitude is considerably changed in a short section in the vicinity of the center, and the amplitude of the section is larger than those of the surrounding sections.

As described above, among waveforms having a predetermined time length, a waveform having large amplitude only in a considerably short section is determined as a waveform of click noise. Noise having such a waveform is also referred to as petit noise or pulse noise which is offensive to the ear.

In the signal processing apparatus 11, when click noise is to be detected, an input signal is converted into absolute values. However, since human ears do not recognize click noise by a sign of an amplitude value, conversion of an input value into absolute values does not affect the detection of click noise. Note that, the human ears recognize click noise due to a considerable change of amplitude, that is, dramatic increase and decrease of power within a short period of time.

Referring back to the flowchart illustrated in FIG. 4, after the input signal is converted into absolute values, the representative-value determination unit 52 divides the input signal which has been converted into absolute values and supplied from the full-wave rectifying circuit 51 into blocks and obtains representative values to be supplied to the average-value calculation unit 53 in step S12.

Figure 6:
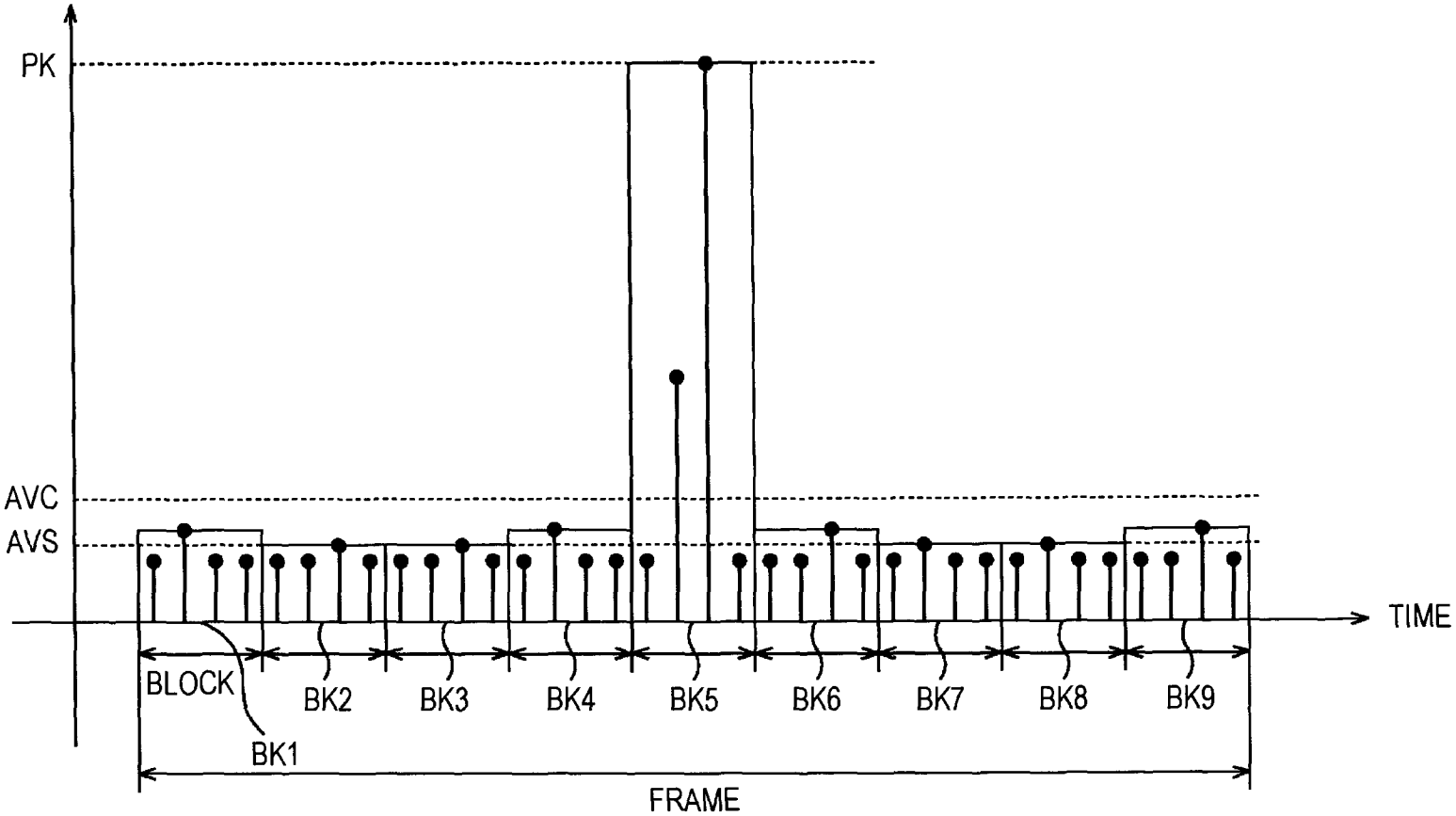
FIG. 6 is a diagram illustrating representative values of blocks.

As illustrated in FIG. 6, the representative-value determination unit 52 divides the input signal into blocks corresponding to sections each of which includes four samples which are consecutively arranged in a time direction of the input signal, for example. Note that, in FIG. 6, circles represent individual samples of the input signal, and positions of the samples in a vertical direction represent sample values. In an example shown in FIG. 6, the input signal is divided into nine blocks including blocks BK1 to BK9. The representative-value determination unit 52 determines that a maximum value among sample values of the four samples included in each of the blocks as a representative value of the block.

In step S13, the average-value calculation unit 53 obtains a maximum value and an average value of representative values of the blocks included in a frame using the representative values of the blocks supplied from the representative-value determination unit 52 and supplies the maximum value and the average value to the determination unit 54.

For example, as shown in FIG. 6, the average-value calculation unit 53 determines that a section including the nine blocks BK1 to BK9 which are consecutive in the time direction as one frame, and determines the frame as a frame to be processed. Then, the average-value calculation unit 53 obtains a maximum value and an average value of representative values of the blocks BK1 to BK9 included in the frame.

For example, in the example shown in FIG. 6, since the representative value of the block BK5 is largest among the representative values of the blocks included in the frame, the representative value of the block BK5 is determined as a maximum value PK of the representative values of the frame. Furthermore, an average value AVC of the representative values of the blocks is larger than an average value AVS of the values of all the samples included in the frame.

In step S14, the determination unit 54 obtains a ratio of the maximum value to the average value for each frame supplied from the average-value calculation unit 53. For example, when the maximum value of the representative values of the blocks included in the frame to be processed is represented by PK and an average value of the representative values of the blocks included in the frame is represented by AVC, the determination unit 54 calculates a ratio RT of the maximum value and the average value as follows: RT=(PK/AVC).

In step S15, the determination unit 54 determines whether the frame to be processed includes click noise in accordance with the obtained ratio RT of the maximum value to the average value. Specifically, when the obtained ratio RT is equal to or larger than a predetermined threshold value th, it is determined that the frame to be processed includes click noise.

For example, when the threshold value th is "3", the maximum value PK is three times or more larger than the average value AVC in the example shown in FIG. 6. Accordingly, it is determined that the frame includes click noise. In this case, the block BK5 having the maximum value PK should include the click noise.

In the signal processing apparatus 11, accuracy of the detection of click noise is improved since the average value of the representative values of the blocks is used instead of an average value of the values of the samples of the input signal.

Figure 7:
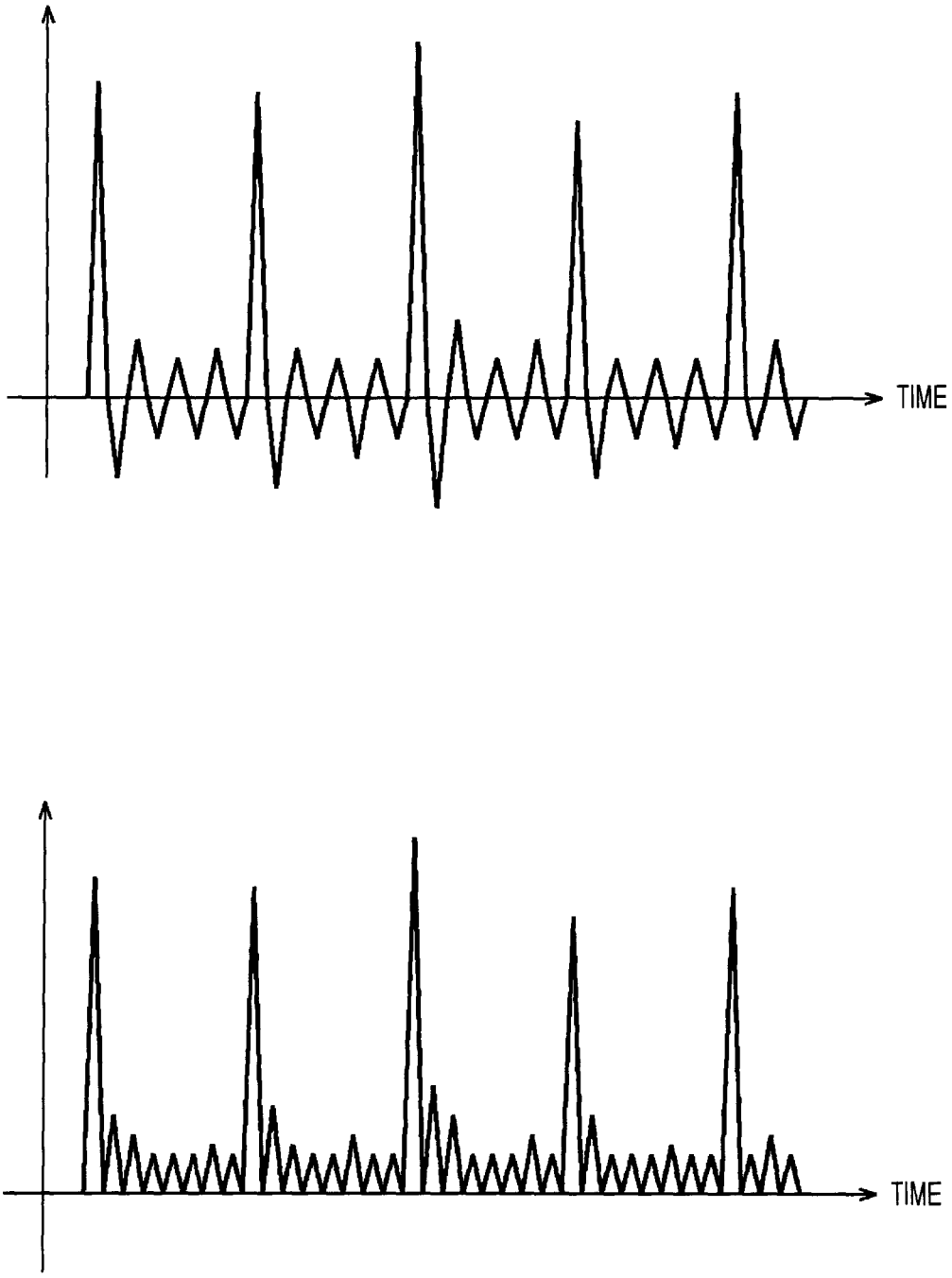
FIG. 7 is a diagram illustrating detection of click noise.

It is assumed that, as shown in an upper portion in FIG. 7, a signal which includes some of samples having large amplitudes (sample values) and which has a small average value of amplitudes of all samples is input. Note that, in FIG. 7, axes of ordinate represent amplitude of the input signal and axes of abscissa represent time.

Although the input signal shown in the upper portion in FIG. 7 includes a section in which amplitude is dramatically changed, amplitude of some sections near the section is also dramatically changed. Therefore, the input signal is not to be detected as click noise, that is, the input signal may correspond to normal sound such as music.

When the input signal is to be processed, the input signal is converted into absolute values. By this, an input signal shown in a lower portion in FIG. 7 is obtained. The input signal shown in the lower portion in FIG. 7 includes samples having large amplitude at equal intervals.

Figure 8:
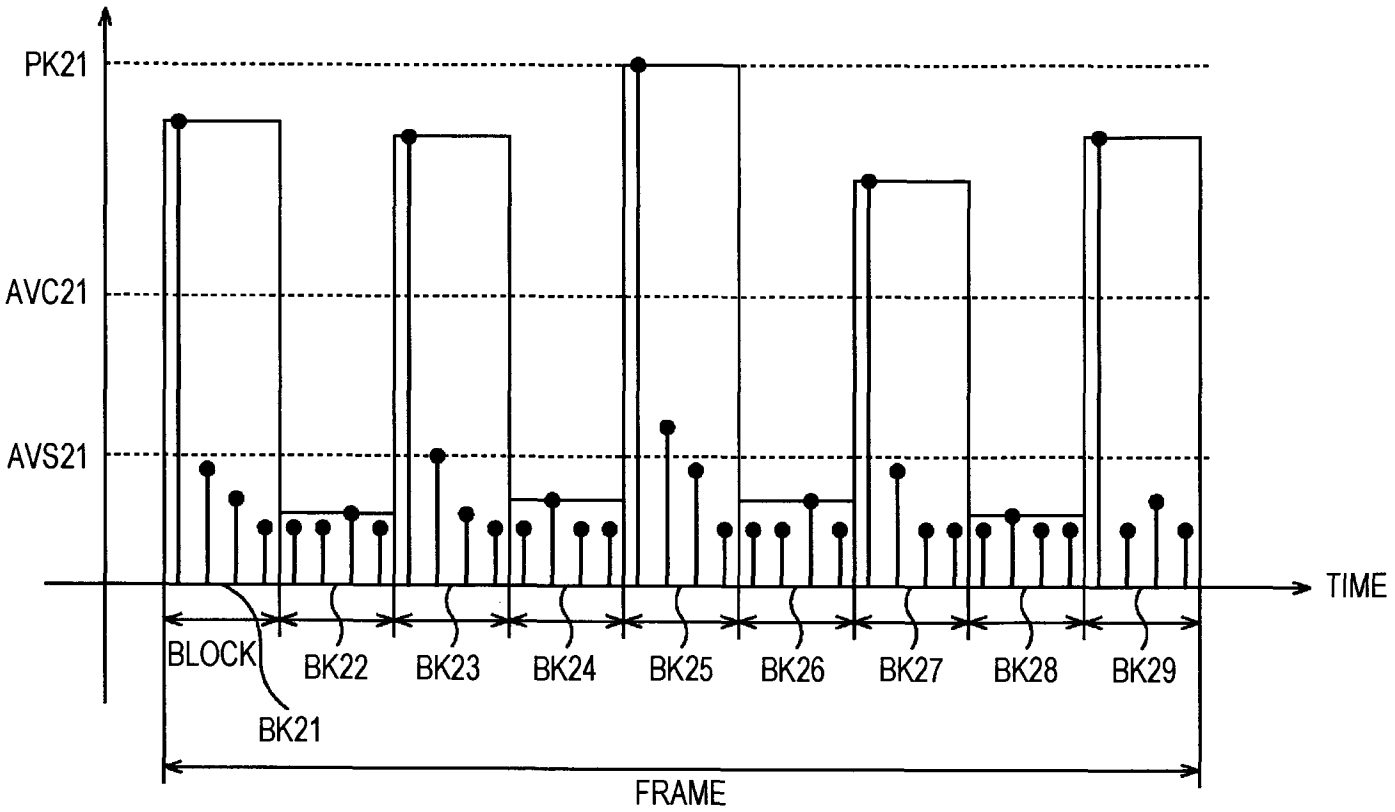
FIG. 8 is a diagram illustrating another detection of the click noise.

Then, the input signal which has been converted into the absolute values is divided into blocks as shown in FIG. 8, and an average value and a maximum value of representative values of the blocks included in a section corresponding to a frame are obtained. Note that, in FIG. 8, an axis of ordinate represents amplitude of the input signal whereas an axis of abscissa represents time. Furthermore, nine consecutive blocks BK 21 to BK29 of the input signal are included in one frame. In this frame, a maximum value PK21 of the representative values of the blocks and an average value AVC21 of the representative values of the blocks are obtained.

Assuming here that a threshold value th for detection of click noise is "3", since a ratio TR of the maximum value to the average value (TR=(PK21/AVC21)) is smaller than the threshold value th "3" in this example, it is reliably determined that the frame does not include click noise.

On the other hand, the ratio (PK21/AVS21) of the maximum value PK21 to an average value AVS21 of values of all the samples included in the frame is equal to or larger than the threshold value th "3". Therefore, if the determination as to whether the frame to be processed includes click noise is performed by comparing this ratio with the threshold value th, it may be determined that a normal sound wavelength corresponds to click noise.

As described above, by detecting click noise using the ratio of the maximum value of the representative values of the blocks to the average value of the representative values of the blocks, a waveform (undulation) of the entire frame is reliably recognized and accuracy of the detection is further improved. That is, it may be more reliably determined whether even an input signal which is likely to be mistakenly detected as click noise such as an audio signal having a small average value of entire amplitude which is considerably changed in some sections includes click noise.

Note that, although, in the foregoing description, it is determined whether the frame includes click noise using the maximum value and the average value of the representative values of the blocks included in the frame, the determination may be made using not only the frame to be processed but also the frame to be processed and frames in the vicinity of the frame. When the detection of click noise is performed using a plurality of frames including the frame to be processed, accuracy of the detection of click noise may be further improved.

Figure 9:
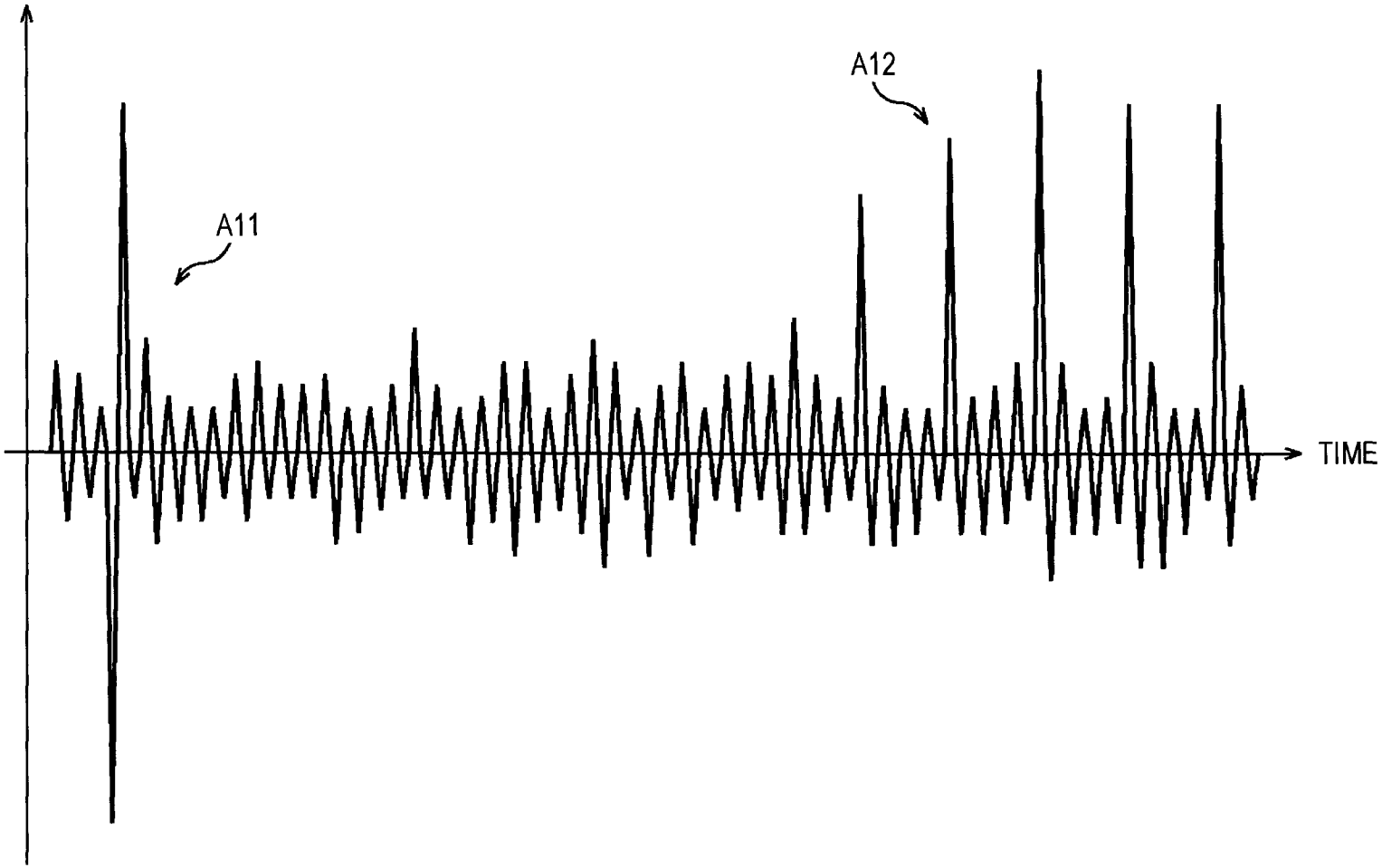
FIG. 9 is a diagram illustrating further detection of the click noise.

It is assumed that a signal having an audio waveform illustrated in FIG. 9 is input as an input signal. Note that, in FIG. 9, an axis of ordinate represents amplitude and an axis of abscissa represents time.

The audio waveform illustrated in FIG. 9 corresponds to a waveform of an audio signal obtained by collecting a sound "ka" produced by a person. Such a waveform of a sound which starts with a consonant "t", "k", or "p" rises in a pulse form similarly to click noise as designated by an arrow mark A11, and thereafter, a level of amplitude is lowered. Then, a pitch waveform is continued as designated by an arrow mark A12.

Since the waveform is generated when the sound "ka" is produced, the waveform does not represent click noise. However, in a case where a frame to be processed includes the rising portion designated by the arrow mark A11 but does not include the pitch waveform portion designated by the arrow mark A12, if detection of click noise is performed only using one of frames, false detection may occurs. That is, a consonant portion corresponding to a leading portion of the sound denoted by the arrow mark A11 may be detected as click noise.

Figure 10:
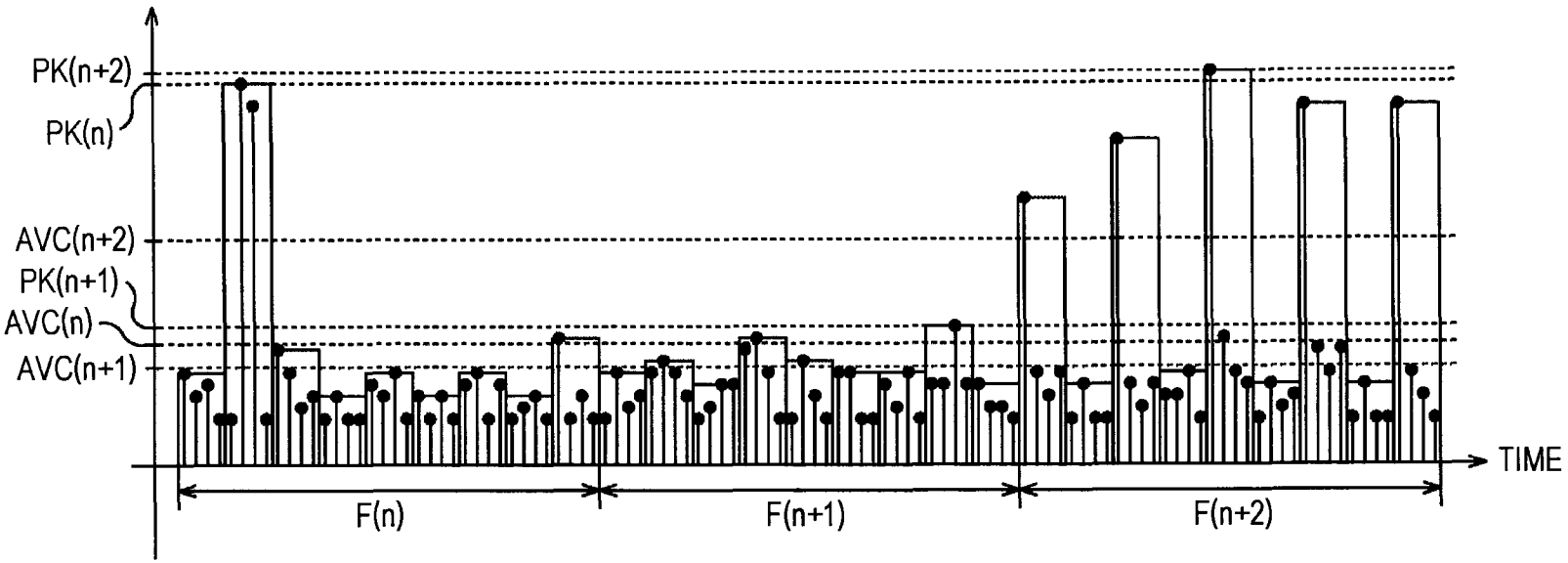
FIG. 10 is a diagram illustrating still further detection of the click noise.

Accordingly, when the detection of click noise is performed using representative values of blocks of some of the frames, accuracy of the detection is further improved. Specifically, it is assumed that an input signal having the audio waveform illustrated in FIG. 9 is divided into three frames F(n) to F(n+2) as shown in FIG. 10. Note that, in FIG. 10, an axis of ordinate represents amplitude and an axis of abscissa denotes time. Furthermore, circles shown in FIG. 10 represent individual samples of the input signal.

In an example shown in FIG. 10, a rising portion of the audio waveform, that is, a consonant portion is included in the frame F(n). A portion between the consonant portion and a pitch waveform portion is included in the frame F(n+1). Furthermore, the portion of the pitch waveform is included in the other frame F(n+2). Note that, in the input signal, the frame F(n) is a preceding frame relative to the other frames F(n+1) and F(n+2).

When a maximum value and an average value of representative values of blocks are obtained for each frame, a maximum value PK(n) and an average value AVC(n) are obtained in the frame F(n), a maximum value PK(n+1) and an average value AVC(n+1) are obtained in the frame F(n+1), and a maximum value PK(n+2) and an average value AVC(n+2) are obtained in the frame F(n+2).

Here, in the frames F(n) and F(n+2), the maximum values PK(n) and PK(n+2) are large to some extent due to the consonant portion and the pitch waveform portion. On the other hand, since the frame F(n+1) does not include a sample having large amplitude, the maximum value PK(n+1) is comparatively small.

Furthermore, since the frames F(n) and F(n+1) include only a small number of samples having large amplitude, the average values AVC(n) and AVC(n+1) are comparatively small. On the other hand, in the frame F(n+2) including a pitch waveform having large amplitude, the average value AVC(n+2) is comparatively large.

It is now assumed that the frame F(n) corresponds to a frame to be processed. For example, the determination unit 54 obtains ratios of the maximum value PK(n) of the frame F(n) to be processed to the individual average values AVC(n) to AVC(n+2) of the frames F(n) to frames F(n+2), respectively, and compares the individual ratios with a threshold value th.

Then, in a condition in which ((PK(n)/AVC(n)≥th), (PK(n)/AVC(n+1)≥th), and (PK(n)/AVC(n+2)≥th)) are satisfied, it is determined that the frame F(n) to be processed includes click noise. That is, when the maximum value PK(n) is larger than a value obtained by multiplying each of the average values of the frames F(n) to F(n+2) by the threshold value, only amplitude of a portion of a block having the maximum value PK(n) as a representative value may be considerably projected in the consecutive three frames. Therefore, in this case, it is determined that the frame F(n) includes click noise.

Furthermore, in a case where inequalities PK(n)/AVC(n) ≥th and PK(n)/AVC(n+2)<th are satisfied, the maximum value PK(n) is not considerably projected when compared with a degree of the average amplitude of the frame F(n+2) and does not correspond to click noise. Therefore, in this case, it is determined that the frame F(n) does not include click noise.

As described above, by comparing a maximum value of a frame to be processed with average values of other frames near the frame to be processed, accuracy of the detection of click noise may be improved.

Note that, click noise may be detected in another way such that a maximum value of a frame to be processed is compared with maximum values of other frames near the frame to be processed. In this case, when the maximum value PK(n) of the frame F(n) to be processed is larger than the maximum values PK(n+1) and PK(n+2) by a predetermined value, for example, it is determined that the frame F(n) includes click noise.

Referring back to the flowchart shown in FIG. 4, when it is determined that the frame does not include click noise in step S15, the determination unit 54 supplies a result of the determination representing that the frame to be processed does not include click noise to the noise section determination unit 81.

Then, the noise section determination unit 81 instructs the replacing unit 85 to output an output signal representing the frame to be processed of the input signal in accordance with the result of the determination supplied from the determination unit 54. The replacing unit 85 outputs the output signal representing a section corresponding to the frame to be processed of the input signal in accordance with the instruction supplied from the noise section determination unit 81, and thereafter, the process proceeds to step S21.

On the other hand, when it is determined that the frame includes click noise in step S15, the determination unit 54 supplies a result of the determination representing that the frame to be processed includes click noise to the noise section determination unit 81, and thereafter, the process proceeds to step S16.

Here, the result of the determination representing that click noise is included includes representative values of the blocks included in the frame to be processed and frames which are adjacent to the frame to be processed so as to sandwich the frame to be processed, a maximum value of the representative values, and an average value of the representative values.

In step S16, the noise section determination unit 81 specifies a noise section including click noise in the section corresponding to the frame to be processed of the input signal using the determination result of the click noise supplied from the determination unit 54.

Figure 11:
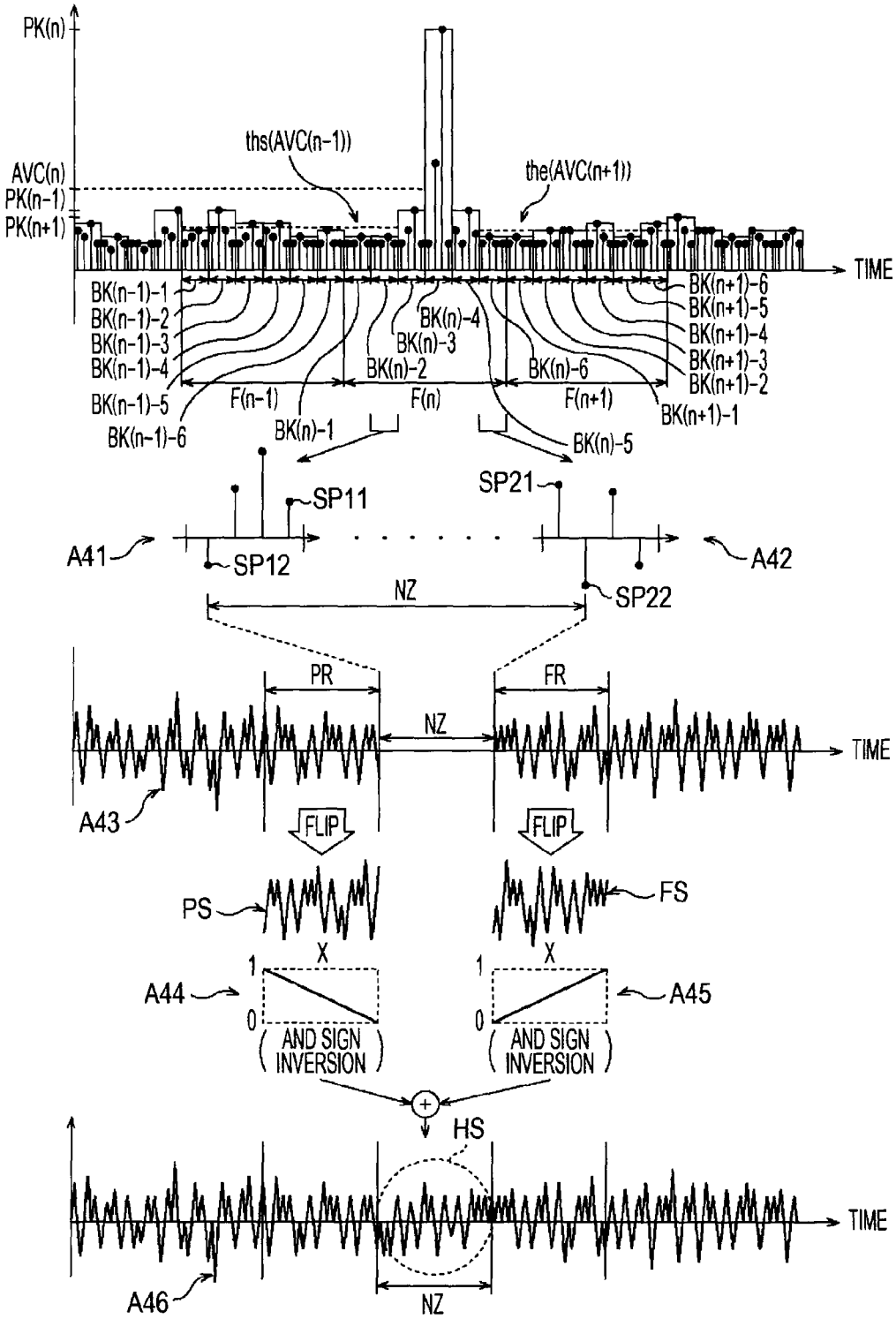
FIG. 11 is a diagram illustrating generation of an interpolation waveform.

For example, as shown in an upper portion of FIG. 11, it is assumed that the determination unit 54 supplies maximum values PK(n−1) to PK(n+1) and average values AVC(n−1) to AVC(n+1) of three frames F(n−1) to F(n+1) which are temporally consecutively arranged to the noise section determination unit 81. Furthermore, it is assumed that the determination unit 54 supplies representative values of blocks included in the frames F(n−1) to F(n+1) to the noise section determination unit 81.

Note that, in FIG. 11, axes of abscissa represent time and axes of ordinate represent amplitude of an input signal. Furthermore, the frame F(n−1) is a preceding frame relative to the other frames F(n) and F(n+1).

In FIG. 11, the frame F(n−1) includes six blocks BK(n−1)−1 to BK(n−1)−6. Similarly, the frame F(n) includes blocks BK(n)−1 to BK(n)−6, and the frame F(n+1) includes blocks BK(n+1)−1 to BK(n+1)−6. Furthermore, in the frame F(n) to be processed, the block BK(n)−4 has a representative value serving as a maximum value PK(n). Note that, in an upper portion in FIG. 11, circles represent individual samples of the input signal, and vertical positions of the samples represent sample values.

First, the noise section determination unit 81 detects a starting position of a noise section of click noise including the block BK(n)−4 having the representative value serving as the maximum value PK(n), that is, a left end of the noise section in the drawing. In this case, the noise section determination unit 81 uses the average value AVC(n−1) of representative values of the blocks of the frame F(n−1) which is the preceding frame relative to the frame F(n) to be processed and which is positioned adjacent to the frame F(n) to be processed as a threshold value ths.

Then, the noise section determination unit 81 detects the first block which has a representative value smaller than the threshold value ths in a past direction from the block BK(n)−4 which is a center of the click noise. The detected block is determined as a noise starting block.

It is assumed that, in FIG. 11, a representative value of the block BK(n)−3 which is located adjacent to the block BK(n)−4 in the past direction is larger than the threshold value ths and a representative value of the block BK(n)−2 which is adjacent to the block BK(n)−3 in the past direction (left side in FIG. 11) is equal to or smaller than the threshold value ths. In this case, the block BK(n)−2 is the first block in the past direction having the representative value which is equal to or smaller than the threshold value ths. Accordingly, the block BK(n)−2 is determined as the noise starting block.

Furthermore, the noise section determination unit 81 refers to a section corresponding to the block BK(n)−2 serving as the noise starting block of the input signal so as to specify a sample which first performs zero-cross in the past direction from the last sample in the section (block). Then, a position of the specified sample is determined as a starting position of the noise section.

For example, as designated by an arrow mark A41 shown in FIG. 11, a sample which has a value of a sign opposite to that of a value of the most succeeding sample in the section corresponding to the block BK(n)−2 of the input signal, that is, the last sample of the section, and which is located on the most future side among such samples in the section corresponding to the block BK(n)−2 of the input signal is specified.

In FIG. 11, a section of the input signal corresponding to the block BK(n)−2 designated by the arrow mark A41 is determined to be processed. Note that, in FIG. 11, circles represent individual samples of the input signal, and vertical positions of the samples represent sample values. For example, samples corresponding to circles located on upper portions of vertical lines in the drawing have positive sample values whereas samples corresponding to circles located on lower portions of vertical lines have negative sample values. Furthermore, in FIG. 11, a horizontal direction represents time, and especially, the right direction corresponds to a future direction.

Here, in the portion of the input signal designated by the arrow mark A41, a sample SP11 located in a right end in the drawing corresponds to the last sample of the section corresponding to the block BK(n)−2 of the input signal, that is, the latest sample in the section. Since a value of the sample SP11 is a positive value, a sample which has a negative value, which is located in a past position relative to the sample SP11, and which is located nearest the sample SP11 corresponds to a sample located in the starting position of the noise section. Therefore, in FIG. 11, a sample SP12 which is temporally located before the sample SP11 by three samples corresponds to the sample located in the starting position of the noise section.

After specifying the starting position of the noise section in this way, the noise section determination unit 81 detects a terminating position of the noise section of the click noise, that is, a right end of the noise section in the drawing, which includes the block BK(n)−4 having the maximum value PK(n) serving as the representative value. In this case, the noise section determination unit 81 uses the average value AVC(n+1) of representative values of the blocks included in the frame F(n+1) which is located adjacent to the frame F(n) to be processed in a future direction as a threshold value the.

The noise section determination unit 81 detects the first block which has a representative value equal to or smaller than the threshold value the in the future direction from the block BK(n)−4 which is the center of the click noise, and determines the detected block as a noise terminating block.

It is assumed that, in FIG. 11, a representative value of the block BK(n)−5 which is adjacent to the block BK(n)−4 in the future direction is larger than the threshold value the, and a representative value of the block BK(n)−6 which is located adjacent to the block BK(n)−5 in the future direction (the right side in the drawing) is equal to or smaller than the threshold value the. In this case, when viewed from the block BK(n)−4, the block BK(n)−6 is a block which is located on a future side and which has the representative value equal to or smaller than the threshold value the first. Accordingly, it is determined that the block BK(n)−6 corresponds to the noise terminating block.

Furthermore, the noise section determination unit 81 refers to a section corresponding to the block BK(n)−6 serving as the noise terminating block in the input signal so as to specify a sample which performs zero-cross first in the future direction from a leading sample of the section (block). Then, a location of the sample is determined as a termination position of the noise section.

For example, as designated by an arrow mark A42 shown in FIG. 11, a sample which has a value of a sign opposite to that of a value of the leading sample SP21 in the section corresponding to the block BK(n)−6 of the input signal, that is, the temporally oldest sample, and which is located on the most past side among such samples in the section corresponding to the block BK(n)−6 of the input signal is specified.

In FIG. 11, in the portion in the input signal designated by the arrow mark A42, the sample SP21 which is located in a left end corresponds to the leading sample of the section of the input signal corresponding to the block BK(n)−6. Since the sample SP21 has a positive value, a sample which is located on the future side relative to the sample SP21, which has a negative value, and which is located nearest the sample SP21 among such samples is determined as a sample located in a termination position of the noise section. Therefore, in FIG. 11, a sample SP22 which is adjacent to the sample SP21 is determined to be the sample located in the termination position of the noise section.

A section from the starting position to the termination position, that is, a section from the sample SP12 to the sample SP22, which is specified as described above corresponds to a noise section NZ. Note that, a length of the noise section NZ is especially referred to as an "interpolation length".

As described above, in the signal processing apparatus 11, average values of frames which sandwich the frame F(n) to be processed are used as threshold values, and a section including blocks having representative values larger than the threshold values is determined as the noise section NZ.

It is assumed that click noise is not included in the frames which sandwich the frame F(n) to be processed, average values of representative values of the frames located before and after the frame F(n) represent average values of large amplitude in the vicinity of the frame F(n) in the input signal. Since representative values of blocks included in a portion of the click noise may be larger than the average values, a section including blocks having representative values larger than the average values which are consecutively aligned corresponds to a section of the click noise. Accordingly, when the average values of the frames before and after the frame F(n) to be processed are used as the threshold values, the section of the click noise is reliably specified.

Note that the noise section may be determined such that a length of the noise section has a value corresponding to a power of two.

In this case, if the number of samples in a section from the noise starting position to the noise terminating position, that is, a section from the sample SP12 to the sample SP22 corresponds to the power of two, the section from the sample SP12 to the sample SP22 is determined as a noise section without change.

On the other hand, when the number of samples in the section from the sample SP12 to the sample SP22 does not correspond to the power of two, among values corresponding to the power of two which are larger than the number of samples in the section from the sample SP12 to the sample SP22, the smallest value is determined as a length of the noise section. It is assumed that the number of samples in the section from the sample SP12 to the sample SP22 is "368". Since "368" is not a value corresponding to the power of two, a value "512" which is larger than "368" but which is the smallest value corresponding to the power of two is determined as the length of the noise section.

Furthermore, when the length of the noise section represents a value corresponding to the power of two, the starting position of the noise section is located in the sample SP12, that is, located in a position of a sample which first performs zero-cross viewed from an end of the noise starting block. Therefore, a terminating position of the noise section is located in a terminal end of the section which has the length corresponding to the power of two and which is started from the position of the sample SP12.

As described above, since the length of the noise section is determined to be the smallest value among values which correspond to the power of two and which are equal to or larger than the number of samples in the section from the sample SP12 to the sample SP22, a calculation amount of an interpolation process performed in a latter stage may be reduced. Specifically, for example, a process in step S19 which will be described hereinafter, that is, a weighting calculation performed at a time of cross-fade of a preceding interpolation waveform and a succeeding interpolation waveform, may be realized only by multiplication and shift operation.

Furthermore, in the foregoing description, the noise starting position and the noise terminating position are reliably specified by specifying samples which first perform zero-cross from the ends of the noise starting block and the noise terminating block. However, this process may not be performed. In this case, for example, a leading sample of the noise starting block is determined as a starting position of the noise section whereas a last sample of the noise terminating block is determined as a terminating position.

As described above, by omitting a process of searching for zero-cross points and performing interpolation for each block, a calculation amount is reduced and a noise section is immediately specified. In this case, since the starting position and the terminating position of the noise section may not correspond to zero-cross points, a direct current component may be slightly generated due to interpolation of the noise section. However, it is less likely to deteriorate acoustic quality.

Referring back to the flowchart shown in FIG. 4, when the noise section NZ is specified, the noise section determination unit 81 supplies information representing the specified noise section NZ such as information representing the starting position and the terminating position of the noise section NZ to the past interpolation waveform generation unit 82, the future interpolation waveform generation unit 83, and the replacing unit 85. Thereafter, the process proceeds from step S16 to step S17.

In step S17, the past interpolation waveform generation unit 82 generates a past interpolation waveform using a sample which has the interpolation length and which is located in the past relative to the noise starting position and using the information representing the noise section NZ supplied from the noise section determination unit 81 and supplies the past interpolation waveform to the synthesis unit 84.

For example, when a signal having a waveform designated by an arrow mark A43 shown in FIG. 11 is input, the past interpolation waveform generation unit 82 extracts a section PR which has the interpolation length and which is located immediately before the noise section NZ of the input signal, and performs time reversal so as to generate a past interpolation waveform PS.

Specifically, the section PR of the input signal is adjacent to the noise section NZ on a past side, that is, adjacent to the noise section NZ on a left side in FIG. 11. Furthermore, the section PR has a length equal to that of the noise section NZ. Therefore, a position at a right end of the section PR corresponds to a position of a sample which is adjacent to the sample SP12 designated by the arrow mark A41 on a left side. Furthermore, since the past interpolation waveform PS is obtained by performing the time reversal on the section PR of the input signal, a sample adjacent to the sample SP12 on the left side corresponds to a sample at a left end of the past interpolation waveform PS in FIG. 11. Conversely, the sample at the left end of the section PR in FIG. 11 corresponds to a sample at a right end of the past interpolation waveform PS.

In step S18, the future interpolation waveform generation unit 83 generates a future interpolation waveform using a sample which has the interpolation length and which is located on a future side relative to the noise terminating position and using information on the noise section NZ supplied from the noise section determination unit 81, and supplies the future interpolation waveform to the synthesis unit 84.

For example, when the signal having the waveform designated by the arrow mark A43 shown in FIG. 11, the future interpolation waveform generation unit 83 extracts a section FR which has the interpolation length and which is located immediately after the noise section NZ of the input signal and performs time reversal on the section FR so as to generate a future interpolation waveform FS.

Specifically, the section FR is adjacent to the noise section NZ on a future side, that is, adjacent to the noise section NZ on a right side in FIG. 11. Furthermore, the section FR has a length the same as that of the noise section NZ. Therefore, a position at a left end of the section FR in FIG. 11 corresponds to a position of a sample adjacent to the sample SP22 designated by the arrow mark A42 on the right side in FIG. 11. Furthermore, since the future interpolation waveform FS is obtained by performing the time reversal on the section FR, a sample adjacent to the sample SP22 on the right side corresponds to a sample at a right end of the future interpolation waveform FS in FIG. 11. Conversely, a sample at a right end of the section FR in FIG. 11 corresponds to a sample at a left end of the future interpolation waveform FS.

As described above, since the waveforms used for the interpolation of the noise section NZ are generated using the sections which have the interpolation length and which are located before and after the noise section NZ of the input signal, powers of portions in the vicinity of the noise section NZ in the input signal after being subjected to the interpolation may be uniform. By this, a natural waveform is obtained without feeling of strangeness.

Furthermore, since the sections of the input signal before and after the noise section NZ are subjected to the time reversal, the first sample of the past interpolation waveform PS and the last sample of the future interpolation waveform FS correspond to the sample located immediately before the noise section and the sample located immediately after the noise section, respectively. Accordingly, when the interpolation is performed on the noise section using the past interpolation waveform PS and the future interpolation waveform FS, a connection between a waveform to be interpolated and waveforms located in boundaries of the noise section may become more natural without feeling of strangeness.

Referring back to the flowchart shown in FIG. 4, in step S19, the synthesis unit 84 performs cross-fade using the past interpolation waveform PS supplied from the past interpolation waveform generation unit 82 and the future interpolation waveform FS supplied from the future interpolation waveform generation unit 83 so as to generate an interpolation waveform.

Specifically, the synthesis unit 84 multiplies values of samples included in the past interpolation waveform PS by weights designated by an arrow mark A44 shown in FIG. 11, multiplies values of samples included in the future interpolation waveform FS by weights designated by an arrow mark A45, and synthesizes the past interpolation waveform PS and the future interpolation waveform FS.

In an example shown in FIG. 11, a weight to multiply a sample at a left end of the past interpolation waveform PS is "1", and a weight to multiply a sample at a right end of the past interpolation waveform PS is "0". Furthermore, weights to multiply the samples included in the past interpolation waveform PS becomes gradually smaller rightward in FIG. 11.

On the other hand, a weight to multiply a sample at a right end of the future interpolation waveform FS in FIG. 11 is "1", and a weight to multiply a sample at a left end of the future interpolation waveform FS is "0". Furthermore, weights to multiply the samples included in the future interpolation waveform FS become gradually smaller leftward in FIG. 11.

The synthesis unit 84 obtains sums of values of the samples included in the past interpolation waveform PS which are multiplied by the weights and values of the samples included in the future interpolation waveform FS which are multiplied by the weights and which are located so as to correspond to the samples of the past interpolation waveform PS so as to generate an interpolation waveform HS. For example, a sum of a value of the sample at the right end of the past interpolation waveform PS in FIG. 11 which is multiplied by the weight and a value of the sample at the right end of the future interpolation waveform FS which is multiplied by the weight serves as a value of a sample at a right end of the interpolation waveform HS.

Referring back to the flowchart shown in FIG. 4, after generating the interpolation waveform HS, the synthesis unit 84 supplies the generated interpolation waveform HS to the replacing unit 85. The process proceeds from step S19 to step S20.

In step S20, the replacing unit 85 replaces the noise section NZ of the input signal by the interpolation waveform HS supplied from the synthesis unit 84 using the information representing the noise section NZ supplied from the noise section determination unit 81 so that the click noise is reduced.

For example, when a signal having a waveform designated by an arrow mark A46 shown in FIG. 11 is input, the replacing unit 85 replaces the noise section NZ by the interpolation waveform HS so that the click noise is removed from the input signal and outputs a resultant signal to a succeeding stage.

After the noise is removed in step S20 or when it is determined that the click noise is not included in step S15, the process proceeds to step S21 where the signal processing apparatus 11 determines whether the process is to be terminated. For example, when the removal of the click noise has been performed on all sections of the input signal, it is determined that the process is to be terminated.

When it is determined that the process is not to be terminated in step S21, the process returns to step S11 and the operations described above are performed again. That is, a next frame is determined as a frame to be processed, and the detection and the removal of click noise are performed on the frame.

On the other hand, when it is determined that the process is to be terminated in step S21, the noise reduction process is terminated.

As described above, the signal processing apparatus 11 divides an input signal into a plurality of blocks, obtains representative values of the blocks, and detects click noise using a ratio of an average value and a maximum value of the representative values of the blocks included in a frame. Then, the signal processing apparatus 11 specifies a click noise section of the input signal, generates an interpolation waveform using sections which have the same length as the noise section and which are located before and after the noise section, and removes the click noise.

By this, since representative values are calculated for individual blocks and a ratio of an average value to a maximum value of the representative values of a frame including the blocks is obtained, click noise is more reliably detected with a reduced calculation amount with ease. Accordingly, the click noise may be reliably removed from the input signal, and natural sound is obtained in terms of acoustic sense without feeling of strangeness.

Note that, specifically, when a past interpolation waveform or a future interpolation waveform is generated, if signs of samples located before or after a sample at a starting position or a terminating position of a noise section are different from each other, signs of values of samples included in a sample group of a section of the input signal used for interpolation are inverted.

Figure 12:
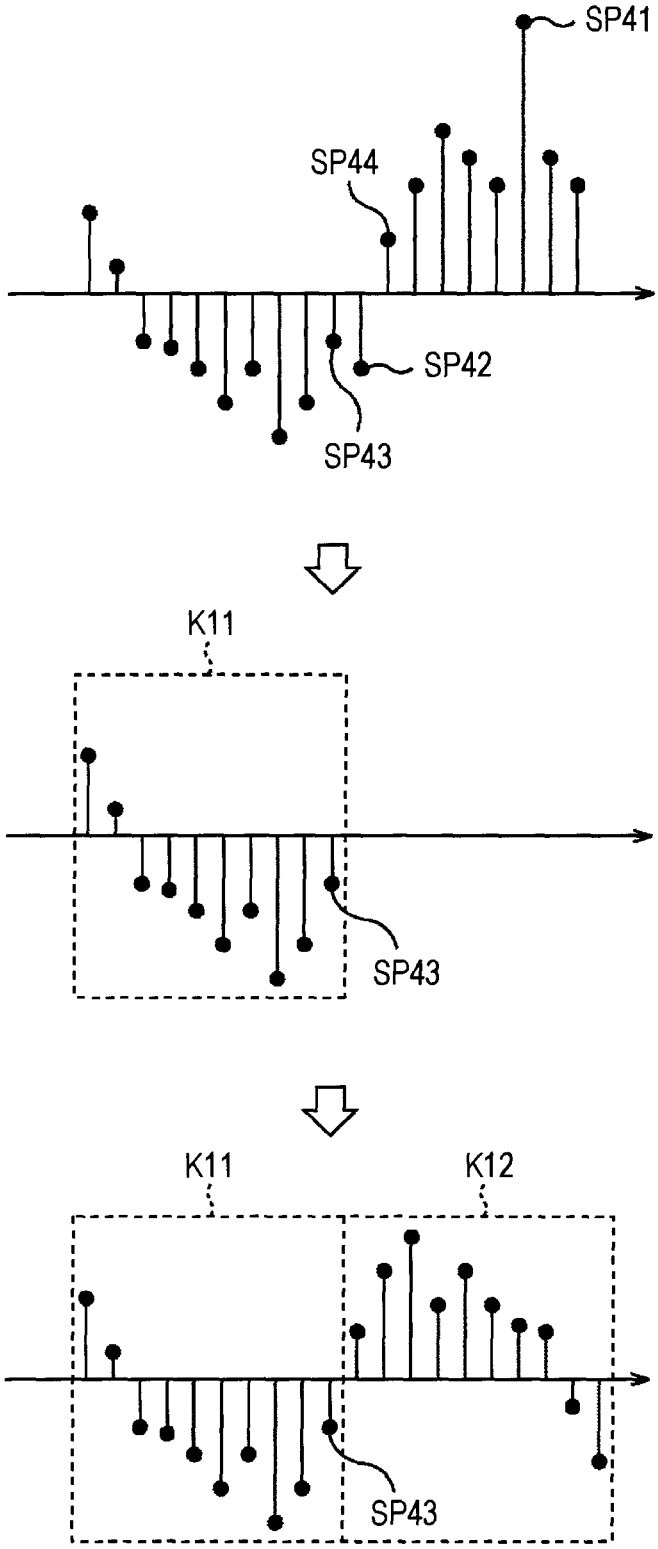
FIG. 12 is a diagram illustrating another generation of an interpolation waveform.

Specifically, it is assumed that, as illustrated in an upper portion of FIG. 12, a sample SP41 corresponds to a peak of click noise and a sample SP42 corresponds to a starting position of a noise section.

Note that, in FIG. 12, circles represent individual samples of an input signal and vertical positions of the samples represent sample values. For example, samples corresponding to circles located on upper sides of vertical lines in the drawing represent samples having positive values as sample values whereas samples corresponding to circles located on lower sides of vertical lines represent samples having negative values as sample values. Furthermore, in FIG. 12, a horizontal direction represents time, and especially, a right direction represents a future direction.

In the input signal illustrated on the upper side of FIG. 12, a portion on a right side relative to the sample SP42 corresponds to a noise section to be converted into an interpolation waveform. Furthermore, a past interpolation waveform used for generation of the interpolation waveform is generated using samples which include a sample SP43 located adjacent to the sample SP42 corresponding to the starting position of the noise section on a left side and which are located in the past relative to the noise section, that is, on a left side in the drawing.

In this case, the past interpolation waveform generation unit 82 determines whether signs of the samples SP43 and SP44 which are temporally located before and after the sample SP42 are the same as each other and generates a past interpolation waveform. For example, in the example shown in FIG. 12, the signs of the values of the samples SP43 and SP44 which sandwich the sample SP42 are different from each other.

Therefore, the past interpolation waveform generation unit 82 extracts a portion of the input signal surrounded by a rectangle K11 which is illustrated in a center portion of the drawing, that is, a section which has the interpolation length (noise section length) and which includes the sample SP43 at a right end in the drawing and performs time reversal on the section. Furthermore, the past interpolation waveform generation unit 82 inverts signs of values of samples of a waveform obtained by performing the time reversal on the portion of the input signal surrounded by the rectangle K11 so as to obtain a past interpolation waveform. By this, as illustrated in a lower portion of FIG. 12, a past interpolation waveform which is surrounded by a rectangle K12 is obtained.

In the lower portion of FIG. 12, the obtained past interpolation waveform is replaced by the noise section of the input signal and is arranged on a right side of the portion corresponding to the rectangle K11. For example, a value of a sample at a left end in the drawing of the past interpolation waveform surrounded by the rectangle K12 is obtained by inverting a sign of the sample SP43 located at the right end of the rectangle K11 which is used for the generation of the past interpolation waveform.

By this, when signs of samples located before and after the sample SP42 at the starting position of the noise section are different from each other, signs of samples included in a section of the input signal used for generation of a past interpolation waveform are inverted when the past interpolation waveform is generated. Accordingly, when the noise section of the input signal is replaced by the past interpolation waveform as illustrated in the lower portion in FIG. 12, a smooth boundary portion at the starting position of the noise section, that is, a smooth connection portion between the input signal and the past interpolation waveform is attained. As a result, when an interpolation waveform obtained by performing cross-fade using the past interpolation waveform and a future interpolation waveform is disposed in the noise section, a signal having a natural waveform is obtained without feeling of strangeness.

Figure 13:
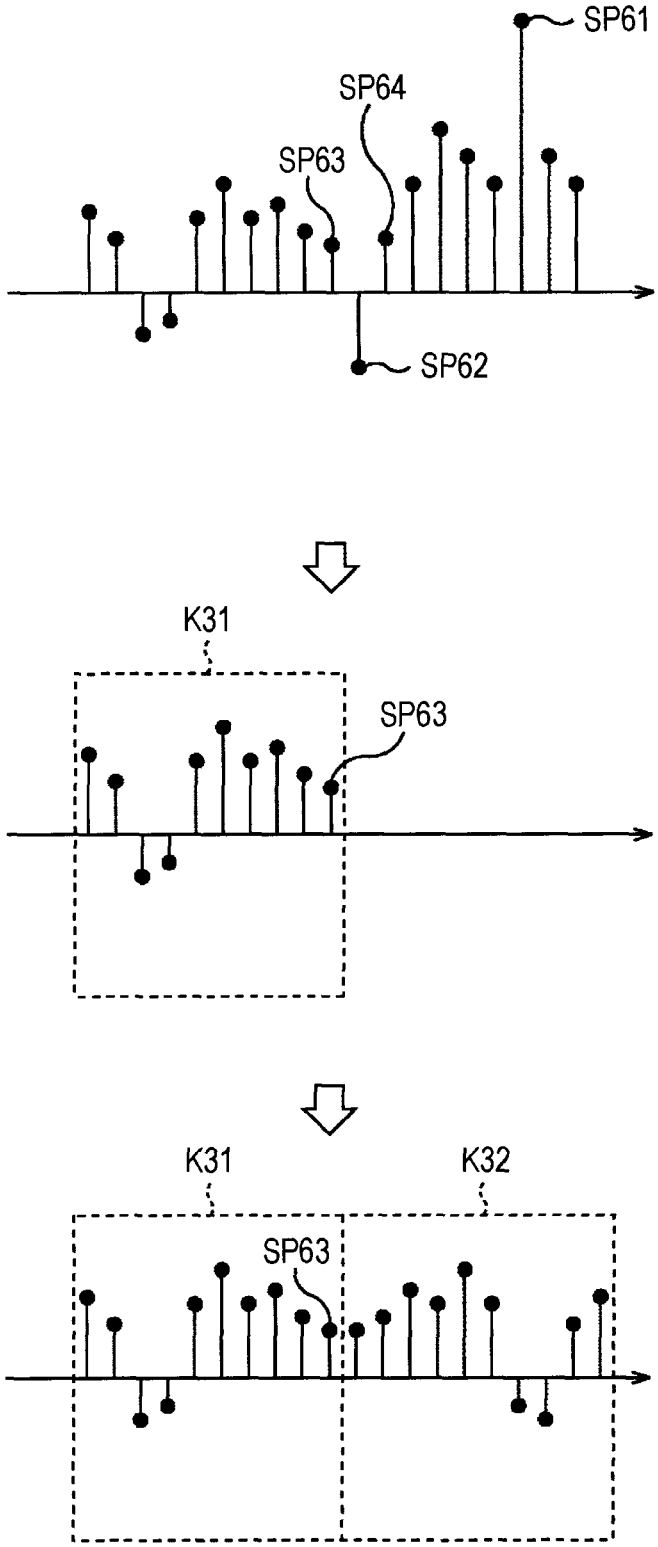
FIG. 13 is a diagram illustrating further generation of an interpolation waveform.

On the other hand, as illustrated on an upper portion of FIG. 13, when signs of values of samples located before and after a sample at a starting position of a noise section are the same as each other, signs of sample values are not inverted when a past interpolation waveform is generated.

Note that, also in FIG. 13, as with the case of FIG. 12, circles represent individual samples of an input signal.

In an example shown in the upper portion of FIG. 13, a sample SP61 of the input signal corresponds to a peak of click noise, and a sample S62 corresponds to a start position of a noise section. Furthermore, in the input signal, a portion on a right side relative to the sample SP62 corresponds to the noise section, and this section is to be replaced by an interpolation waveform. Furthermore, a past interpolation waveform used for generation of the interpolation waveform is generated using samples which are located on a left side relative to the noise section and which include a sample SP63 located adjacent to the sample SP62 on a left side.

Here, the past interpolation waveform generation unit 82 determines whether signs of values of the samples SP63 and SP64 which are temporally located before and after the sample SP62, respectively, are the same as each other. For example, in the example shown in FIG. 13, the signs of the values of the samples SP63 and SP64 which sandwich the sample SP62 are the same as each other.

Therefore, the past interpolation waveform generation unit 82 extracts a portion of the input signal surrounded by a rectangle K31, that is, a section which has the interpolation length and which includes the sample SP63 at a right end thereof as shown in a center portion in the drawing and performs time reversal on the section so as to obtain a past interpolation waveform. By this, as shown in a lower portion of FIG. 13, a waveform surrounded by a rectangular K32, that is, a past interpolation waveform is obtained.

In the lower portion of FIG. 13, the obtained past interpolation waveform is replaced by the noise section of the input signal and is arranged on a right side of the portion corresponding to a rectangle K31. For example, a value of a sample at a left end of the past interpolation waveform surrounded by the rectangle K32 in the drawing is the same as the value of the sample SP63 located at a right end of the rectangle K31 used for the generation of the past interpolation waveform.

As described above, when the signs of the values of the samples located before and after the sample SP62 located in the starting position of the noise section are the same as each other, the signs of the values of samples included in the section of the input signal used for the generation of the past interpolation waveform are not inverted. Accordingly, as shown in the lower portion of FIG. 13, when the noise section of the input signal is replaced by the past interpolation waveform, a smooth boundary portion of the starting position of the noise section, that is, a smooth connection portion between the input signal and the past interpolation waveform is attained. As a result, when an interpolation waveform obtained by performing cross-fade on the past interpolation waveform and a future interpolation waveform is arranged in the noise section, a signal having a natural waveform is obtained without feeling of strangeness.

Note that, as with the case of the past interpolation waveform, in a case where the future interpolation waveform is generated, when signs of values of samples located before and after a noise terminating position are different from each other, signs of values of samples used for the future interpolation waveform are inverted.

Furthermore, in the foregoing description, a maximum value of values of samples included in a block is determined as a representative value of the block. However, the representative block may be determined by a calculation using values of samples included in the block which satisfy a predetermined condition. For example, the representative value may be obtained by performing weighted summation on the values of all the samples included in the block. Alternatively, a predetermined number of samples may be selected in a descending order of the sample values, and an average value of the values of the samples may be determined as the representative value.

Second Embodiment

In the foregoing description, instead of a correlation calculation method, which is accompanied with a large amount of calculation and cost, the method for realizing effective reduction of click noise has been described. The calculation amount is reduced by replacing a waveform in a noise section by an interpolation waveform. However, in this method, when an obtained output signal is reproduced, sound corresponding to a discontinuous waveform of the output signal may be obtained in the vicinity of ends of a noise section which has been replaced by an interpolation waveform.

Figure 14:
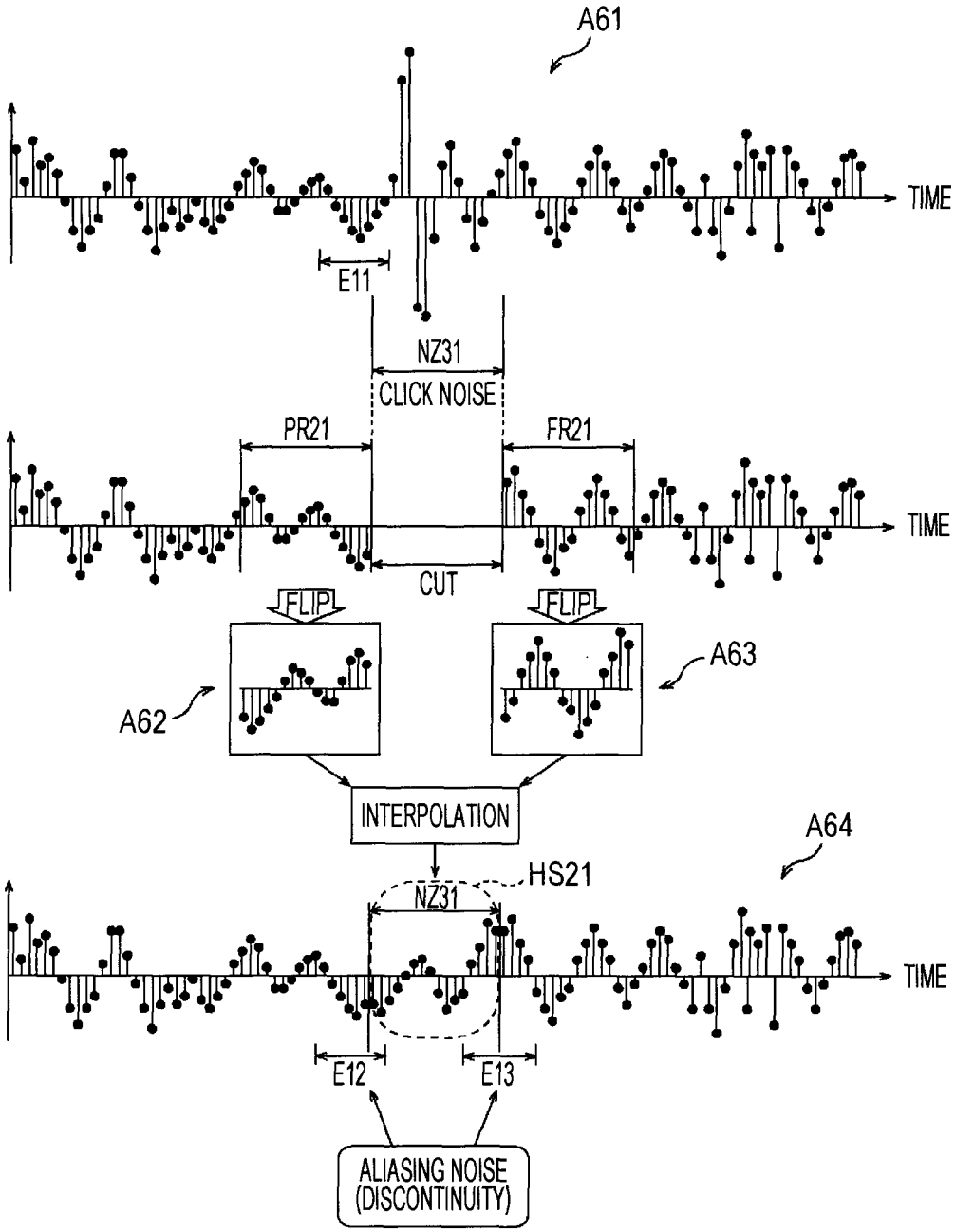
FIG. 14 is a diagram illustrating still further generation of an interpolation waveform.

Specifically, it is assumed that a signal designated by an arrow mark A61 shown in an upper portion in FIG. 14 is input to a signal processing apparatus 11, and a section NZ31 of the input signal is detected as a noise section (hereinafter referred to as a "noise section NZ31").

Note that, in FIG. 14, axes of abscissa represent time and axes of ordinate represent amplitude of the input signal. Furthermore, in FIG. 14, circles represent individual samples of the input signal, and vertical positions of the samples represent sample values. Especially, samples corresponding to circles located on upper sides of vertical lines in the drawing have positive values as sample values whereas samples corresponding to circles located on lower sides of vertical lines in the drawing have negative values as sample values.

As designated by the arrow mark A61, when the noise section NZ31 is detected in the input signal, in the noise reduction process illustrated in FIG. 4, a section PR21 which has an interpolation length and which is located immediately before the noise section NZ31 of the input signal is reversed in a time direction so that a past interpolation waveform is generated as designated by an arrow mark A62. Similarly, a section FR21 which has the interpolation length and which is located immediately after the noise section NZ31 of the input signal is reversed in the time direction so that a future interpolation waveform designated by an arrow mark A63 is generated.

Then, as designated by an arrow mark A64, the noise section NZ31 of the input signal is replaced by an interpolation waveform HS21 obtained by performing cross-fade using the past interpolation waveform and the future interpolation waveform so that click noise is removed.

In this noise removal method, since the final interpolation waveform HS21 is generated using the past interpolation waveform and the future interpolation waveform by performing weighting in accordance with a distance to the noise section NZ31, unnaturalness of the waveform in the noise section NZ31 is reduced. Furthermore, in this method, since discontinuity of sample values at a starting position and a terminating position of the noise section NZ31 is avoided in principle, it is unlikely to generate apparent feeling of strangeness and abnormal sound.

However, when waveforms having low frequencies are included in portions before and after the noise section NZ31 of the input signal, aliasing waveforms apparently appear in the portions before and after the noise section NZ31 of an output signal and the aliasing portions have high frequency components. Therefore, when the output signal is reproduced, abnormal sound corresponding to the discontinuity of a waveform of the output signal is obtained as a result.

In the example shown in FIG. 14, a section E11 located in the vicinity of the starting position of the noise section NZ31 of the input signal designated by the arrow mark A61 in the upper portion of the drawing has a waveform similar to a sine wave of a low frequency. However, in the output signal denoted by the arrow mark A64, a section E12 corresponding to the section E11 in terms of a position includes a signal having a waveform of a high frequency component, and accordingly, inappropriate sound may be obtained.

Similarly, a section E13 located in the vicinity of the noise section terminating position has a waveform including a high frequency component. This is because when the click noise is to be removed, only continuity of sample values is taken into consideration among continuity to be considered in the noise section starting position and the noise section terminating position.

Noise Reduction Process

Accordingly, a noise reduction process may be performed so that a smoother waveform of the interpolation portion of the output signal is obtained. Hereinafter, referring to FIGS. 15 and 16, a noise reduction process in such a case will be described.

Figure 15:
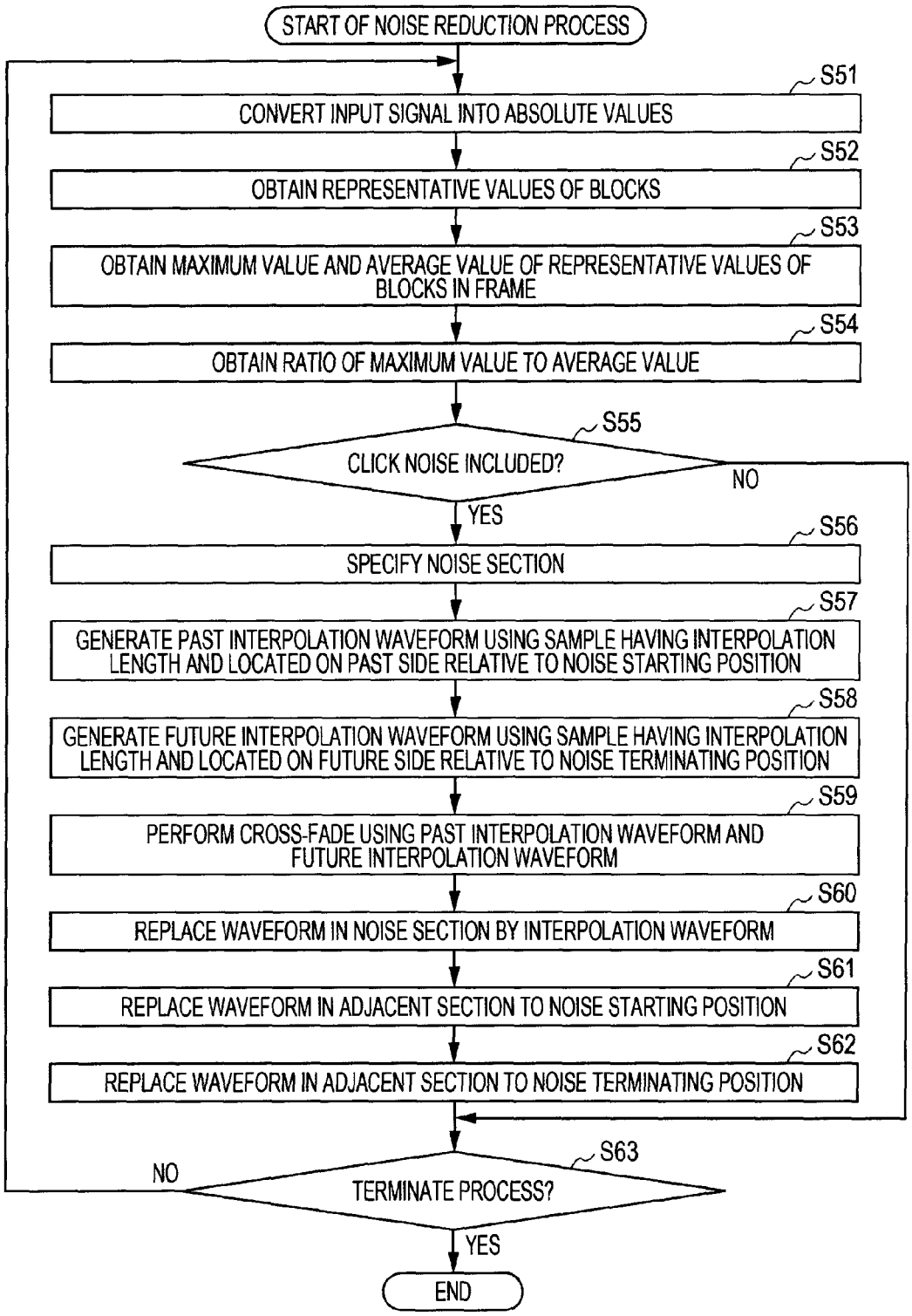
FIG. 15 is a flowchart illustrating a noise reduction process.

FIG. 15 is a flowchart illustrating a noise reduction process performed by the signal processing apparatus 11. Note that a noise section is detected in an input signal from step S51 to step S56 in the noise reduction process illustrated in FIG. 15, and these processes are the same as those in step S11 to step S16 illustrated in FIG. 4. Therefore, descriptions thereof are omitted.

In step S57, a past interpolation waveform generation unit 82 generates a past interpolation waveform using a preceding sample relative to the noise starting position which has the interpolation length using information representing a noise section supplied from a noise section determination unit 81 and supplies the past interpolation waveform to a synthesis unit 84.

Figure 16:
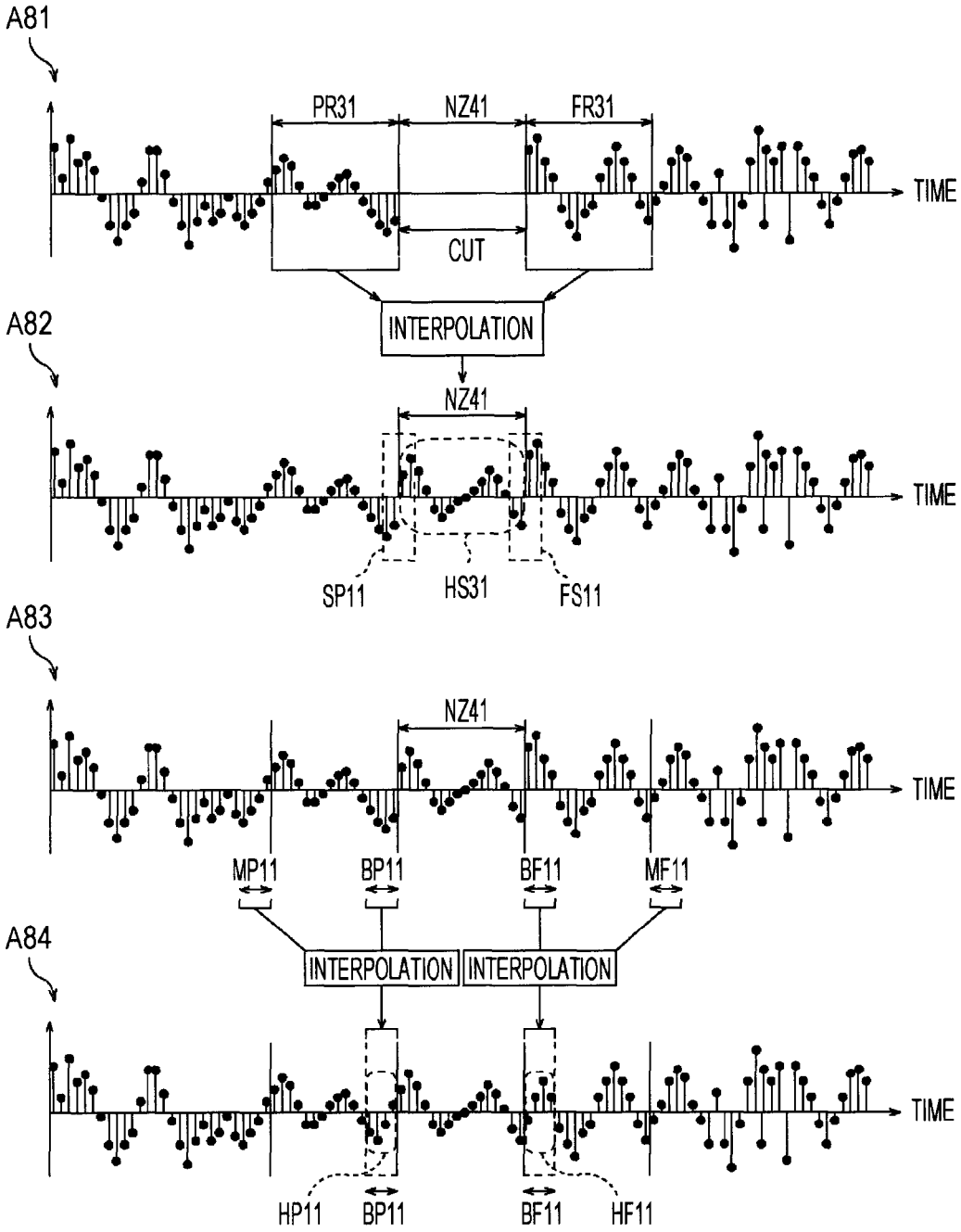
FIG. 16 is a diagram illustrating generation of an interpolation waveform.

For example, when a signal having a waveform designated by an arrow mark A81 shown in FIG. 16 is input, the past interpolation waveform generation unit 82 extracts a section PR31 which is located immediately before a noise section NZ41 of the input signal and which has the interpolation length as the past interpolation waveform.

Note that, in FIG. 16, axes of abscissa denote time and axes of ordinate denote amplitude of the input signal. Furthermore, circles shown in FIG. 16 represent individual samples of the input signal, and vertical positions of the samples represent sample values. Especially, samples corresponding to circles located in upper portions of vertical lines in the drawing have positive values as sample values whereas samples corresponding to circles located in lower portions of vertical lines in the drawing have negative values as sample values.

In an example shown in FIG. 16, the section PR31 corresponding to the past interpolation waveform is located adjacent to the noise section NZ41 on a left side in the drawing, that is, on a past side, and has a length the same as that of the noise section NZ41.

In step S58, a future interpolation waveform generation unit 83 generates a future interpolation waveform using a sample which is located on a future side relative to a noise terminating position and which has the interpolation length using the information representing the noise section supplied from the noise section determination unit 81 and supplies the future interpolation waveform to the synthesis unit 84.

For example, when the signal having the waveform designated by the arrow mark A81 shown in FIG. 16 is input, the future interpolation waveform generation unit 83 extracts a section FR 31 of the input signal which is located immediately after the noise section NZ41 and which has the interpolation length as the future interpolation waveform.

As described above, in the noise reduction process shown in FIG. 15, when the past interpolation waveform and the future interpolation waveform are generated, the extracted samples having the interpolation length are not subjected to time reversal. Furthermore, the section PR31 corresponding to the past interpolation waveform and the section FR31 corresponding to the future interpolation waveform may not be adjacent to the noise section NZ41.

In step S59, the synthesis unit 84 performs cross-fade using the past interpolation waveform supplied from the past interpolation waveform generation unit 82 and the future interpolation waveform supplied from the future interpolation waveform generation unit 83 so as to generate an interpolation waveform.

In step S59, the same process as step S19 in FIG. 4 is performed. Specifically, sums of sample values of the past interpolation waveform and samples values of the future interpolation waveforms are obtained, and the obtained values are determined as values of samples included in the interpolation waveform.

For example, weights to multiply the samples of the past interpolation waveform gradually become smaller toward the future side, and a weight of the most preceding sample in a past direction is "1" and a weight of the most succeeding sample in a future direction is "0". Conversely, weights to multiply the samples of the future interpolation waveform gradually become larger toward the future side, and a weight of the most preceding sample in the past direction is "0" and a weight of the most succeeding sample in the future direction is "1".

After the synthesis unit 84 generates the interpolation waveform and supplies the interpolation waveform to a replacing unit 85, the process proceeds from step S59 to step S60.

In step S60, a replacing unit 85 replaces the noise section of the input signal by the interpolation waveform supplied from the synthesis unit 84 using information representing the noise section supplied from the noise section determination unit 81 so that the click noise of the input signal is reduced.

For example, when a signal designated by an arrow mark A82 shown in FIG. 16 is input, the replacing unit 85 replaces the noise section NZ41 by an interpolation waveform HS31 so that click noise is removed from the input signal.

As described above, in a state in which the noise section NZ41 is simply replaced by the interpolation waveform HS31, discontinuity (jump of sample values) of the waveform apparently occurs in a boundary section PS11 located in the vicinity of a noise starting position and a boundary section FS11 located in the vicinity of a noise terminating position. Note that the boundary section PS11 includes the noise starting position and the boundary section FS11 includes the noise terminating position.

Accordingly, the replacing unit 85 replaces a waveform in the vicinity of the boundary section PS11 and a waveform in the vicinity of the boundary section FS11 by waveforms which are newly generated by cross-fade so as to prevent the generation of the discontinuity of a waveform of an output signal.

Specifically, in step S61, the replacing unit 85 performs replacement of a waveform of the input signal included in a section which is adjacent to the noise starting position of the input signal which is obtained by performing the replacement using the interpolation waveform, that is, the input signal obtained by the process performed in step S60.

Specifically, as designated by an arrow mark A83 shown in FIG. 16, the replacing unit 85 determines a section BP11 which is a predetermined short section and which is adjacent to the noise starting position of the input signal on a past side. That is, the section BP11 is located immediately before the noise section NZ41.

Next, the replacing unit 85 determines a section MP11 which is a predetermined section, which has the same length as the section BP11 and which is temporally located before (past) the section BP11 of the input signal. In an example shown in FIG. 16, the section MP11 is located immediately before the section PR31 corresponding to the past interpolation waveform.

Then, the replacing unit 85 performs cross-fade using a waveform of the section BP11 of the input signal and a waveform of the section MP11 of the input signal and replaces the section BP11 by a waveform HP11 obtained by the cross-fade as designated by an arrow mark A84 so that discontinuity of a waveform is avoided.

For example, when the cross-fade is performed, weights to multiply samples included in the section BP11 become gradually smaller toward a future side, and a weight of the most preceding sample on a past side is "1" and a weight of the most succeeding sample on the future side is "0". Conversely, weights to multiply samples included in the section MP11 gradually become larger toward the future side, and a weight of the most preceding sample in the past side is "0" and a weight of the most succeeding sample in the future side is "1".

Accordingly, in the vicinity of the section BP11 of the input signal which has been replaced by the waveform HP11, a waveform in the vicinity of a terminating position of the section MP11 is smoothly continued to a waveform in the vicinity of a starting position of the section PR31. Accordingly, the discontinuity of the waveform is avoided. As a result, natural sound is obtained without feeling of strangeness in terms of acoustic sense.

Specifically, when the interpolation waveform HS31 is generated, a weight to multiply a sample at a left end of the section PR31 in the drawing is "1" whereas a weight to multiply a sample at a left end of the section FR31 in the drawing is "0". Accordingly, a sample at a left end of the interpolation waveform HS31 in the drawing is the same as the sample at the left end of the section PR31.

On the other hand, when the waveform HP11 is generated, a weight to multiply a sample at a right end of the section MP11 in the drawing is "1" whereas a weight to multiply a sample at a right end of the section BP11 in the drawing is "0". Accordingly, a sample at a right end of the waveform HP11 in the drawing is the same as the sample at the right end of the section MP11.

When the waveform HP11 obtained as described above is arranged immediately before the interpolation waveform HS31, in a boundary portion between the waveform HP11 and the interpolation waveform HS31, the sample at the right end of the section MP11 and the sample at the left end of the section PR31 which are adjacent to each other in the original input signal are arranged adjacent to each other. That is, since the section BP11 of the input signal is replaced by the waveform HP11, a natural and smooth waveform is obtained in the vicinity of the starting position of the noise section NZ41.

Referring back to the flowchart shown in FIG. 15, in step S62, the replacing unit 85 performs replacement on a waveform in a section which is adjacent to the noise terminating position of the input signal obtained through the process in step S61.

Specifically, as designated by the arrow mark A83 shown in FIG. 16, the replacing unit 85 determines a short section which is adjacent to the noise terminating position in the input signal on a future side as a section BF11. In an example shown in FIG. 16, the section BF11 is located immediately after the noise section NZ41.

Next, the replacing unit 85 determines a predetermined section which has the same length as the section BF11 and which is temporally located after the section BF11 of the input signal as a section MF11. In the example shown in FIG. 16, the section MF11 is located immediately after the section FR31 corresponding to a future interpolation waveform.

Then, the replacing unit 85 performs cross-fade on a waveform of the section BF11 and a waveform of the section MF11 and replaces the section BF11 of the input signal by a waveform HF11 obtained by the cross-fade as designated by an arrow mark A84 so that the discontinuity of a waveform is avoided.

For example, when the cross-fade is performed, weights to multiply samples included in the section BF11 gradually become larger toward a future side, and a weight of the most preceding sample on a past side is "0" and a weight of the most succeeding sample on the future side is "1". Conversely, weights to multiply samples of the section MF11 gradually become smaller toward the future side, and a weight of the most preceding sample on the past side is "1" and a weight of the most succeeding sample on the future side is "0".

Accordingly, in the vicinity of the section BF11 of the input signal which has been replaced by the waveform HF11, as with the case of the section BP11, a waveform in the vicinity of a starting position of the section MF11 and a waveform in the vicinity of a terminating position of the section FR31 are smoothly connected to each other. As a result, the discontinuity of a waveform is avoided, and natural sound corresponding to an output signal is obtained without feeling of strangeness in terms of acoustic sense.

The replacing unit 85 outputs the input signal obtained through the process described above to a subsequent stage as the output signal.

Referring back to the flowchart shown in FIG. 15, after the replacement of the waveform is performed in step S62 or after it is determined that click noise is not included in step S55, the process proceeds to step S63.

In step S63, the signal processing apparatus 11 determines whether the process is to be terminated. When removal of the click noise has been performed on all sections of the input signal, for example, it is determined that the process is to be terminated.

When it is determined that the process is not to be terminated in step S63, the process returns to step S51 and the processes described above are performed again. On the other hand, when it is determined that the process is to be terminated in step S63, the noise reduction process is terminated.

As described above, the signal processing apparatus 11 replaces the noise section of the input signal by the interpolation waveform, newly generates waveforms using sections adjacent to the noise section and the sections adjacent to sections used for the generation of the interpolation waveform, and thereafter, replaces the sections adjacent to the noise section by the newly-generated waveforms. By this, connection of the interpolation waveforms is attained so that the discontinuity of a waveform is prevented from being generated, and natural sound is obtained without feeling of strangeness in terms of acoustic sense.

When the noise reduction process illustrated in FIG. 15 is used, a calculation amount is slightly increased when compared with the case of FIG. 4. However, according to the noise reduction process illustrated in FIG. 15, since the noise section is interpolated while discontinuity of a waveform is maintained, and furthermore, the boundary portions of the noise section are interpolated, reduction of noise is more naturally realized without feeling of strangeness.

Note that although the sections BP11 and BF11 which are adjacent to the noise section NZ41 shown in FIG. 16 may have any length as long as the length does not exceed a length of the noise section NZ41, the length should be as short as possible so that strange sound is not reproduced. Furthermore, the sections BP11 and BF11 may have different lengths.

The series of processes described above may be executed by hardware or software. When the series of processes is executed by software, programs included in the software are installed from a program recording medium to a computer which is incorporated in dedicated hardware or a general personal computer capable of executing various functions by installing various programs.

Figure 17:
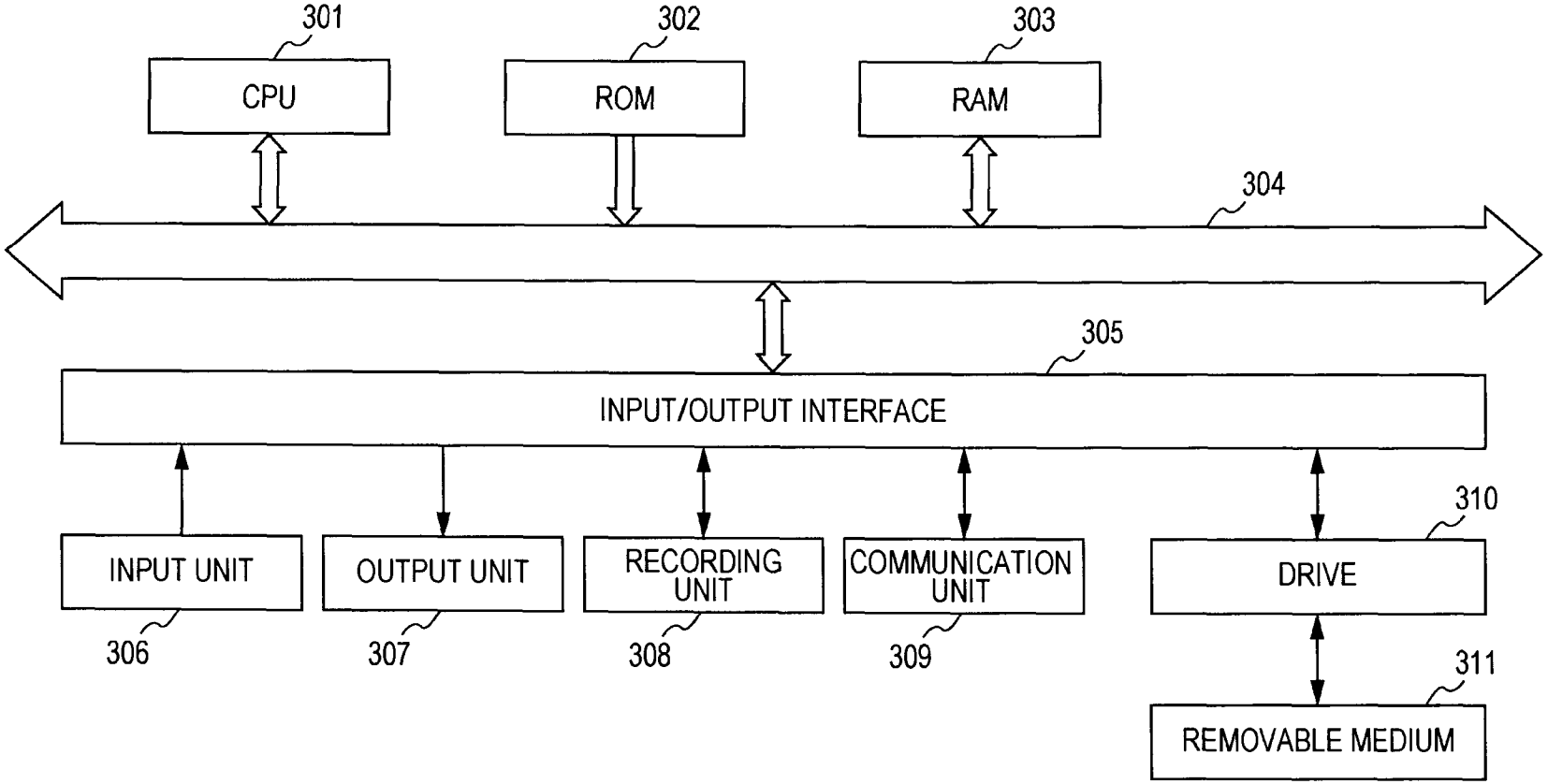
FIG. 17 is a block diagram illustrating a configuration of a computer.

FIG. 17 is a block diagram illustrating a configuration of hardware of a computer which executes the series of processes described above by programs.

In the computer, a CPU (Central Processing Unit) 301, a ROM (Read Only Memory) 302, and a RAM (Random Access Memory) 303 are connected to one another through a bus 304.

An input/output interface 305 is also connected to the bus 304. To the input/output interface 305, an input unit 306 including a keyboard, a mouse, and a microphone, an output unit 307 including a display and a speaker, a recording unit 308 including a hard disk or a nonvolatile memory, a communication unit 309 including a network interface, and a drive 310 which drives a removable medium 311 such as a magnetic disk, an optical disc, a magneto-optical disc, or a semiconductor memory are connected.

In the computer configured as described above, when the CPU 301 loads programs recorded in the recording unit 308 to the RAM 303 through the input/output interface 305 and the bus 304 and executes the programs, the series of processes described above is performed.

The programs executed by the computer (CPU 301) are provided by being recorded in the removable medium 311 which is a package medium such as a magnetic disk (including a flexible disk), an optical disc (a CD-ROM (Compact Disc-Read Only Memory), a DVD (Digital Versatile Disc), or the like), a magneto-optical disc, or a semiconductor memory or by a wired or wireless transmission medium such as a local area network, the Internet, or digital satellite broadcasting.

The programs may be installed in the recording unit 308 through the input/output interface 305 by inserting the removable medium 311 into the drive 310. Furthermore, the programs may be received by the communication unit 309 through the wired or wireless transmission medium and installed in the recording unit 308. Alternatively, the programs may be installed in advance in the ROM 302 or the recording unit 308.

Note that the programs to be executed by the computer may be processed in time series in accordance with the order described in this specification, and alternatively, the programs may be processed in parallel or at a timing when the programs are called.

Note that embodiments of the present invention are not limited to the foregoing embodiment, and various modifications may be made without departing from the scope of the present invention.

The present application contains subject matter related to that disclosed in Japanese Priority Patent Application JP 2010-092817 filed in the Japan Patent Office on Apr. 14, 2010 and Japanese Priority Patent Application JP 2010-175335 filed in the Japan Patent Office on Aug. 4, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing method comprising:

converting an audio signal into absolute values;

calculating representative values of consecutive sample values included in blocks of the audio signal, wherein the audio signal has been converted into the absolute values using at least a maximum sample value among the sample values included in the blocks;

determining a section comprising a predetermined number of consecutive blocks as a frame and calculating a maximum value of the representative values of the consecutive blocks included in the frame and an average value of the representative values of the consecutive blocks included in the frame;

detecting click noise in the frame based on a ratio of the maximum value of the representative values to the average value of the representative values; and outputting the audio signal from which the detected click noise is removed.

2. The signal processing method according to claim 1, further comprising determining that the maximum sample value among the sample values included in the blocks correspond to the representative values for each individual block.

3. The signal processing method according to claim 2, further comprising determining that the frame includes the click noise when the ratio of the maximum value of the representative values to the average value of the representative values is equal to or larger than a predetermined threshold value.

4. The signal processing method according to claim 2, further comprising detecting the click noise in a frame to be processed using the maximum value of the representative values and the average value of the representative values of the frame to be processed and maximum values of the representative values and average values of the representative values of other frames located in the vicinity of the frame to be processed.

5. The signal processing method according to claim 2, further comprising:

generating a past interpolation waveform to be used for interpolation of a noise section including the click noise using a first waveform of a section of the audio signal which has the same length as the noise section and which is located prior to the noise section of the audio signal;

generating a future interpolation waveform to be used for the interpolation of the noise section using a second waveform of a section of the audio signal which has the same length as the noise section and which is located after the noise section of the audio signal;

generating an interpolation waveform by cross-fade using the past interpolation waveform and the future interpolation waveform; and reducing the click noise by replacing the noise section of the audio signal by the interpolation waveform.

6. The signal processing method according to claim 5, further comprising: determining, when the click noise is detected in a frame to be processed, that a noise starting block corresponds to one of the blocks which has a representative value equal to or smaller than a threshold value, wherein the representative value is one of representative values of a frame located immediately before the frame to be processed and which is located prior to one of the blocks which has a maximum representative value of the frame to be processed, and detecting a position of one of a plurality of samples which first performs zero-cross and which is located prior to a last sample included in the noise starting block.

7. The signal processing method according to claim 5, further comprising:

determining, when the click noise is detected in a frame to be processed, that a noise terminating block corresponds to one of the blocks which has a representative value equal to or smaller than a threshold value, wherein the representative value corresponds to one of representative values of a frame located immediately after the frame to be processed and which is located after one of the blocks which has the maximum representative value of the frame to be processed, and detecting a position of one of a plurality of samples which first performs zero-cross and which is located after a leading sample included in the noise terminating block.

8. The signal processing method according to claim 5, further comprising generating the past interpolation waveform by performing time reversal on the first waveform of the section of the audio signal which has the same length as the noise section and which is located adjacent to and prior to the noise section, and generating the future interpolation waveform by performing the time reversal on the second waveform of the section of the audio signal which has the same length as the noise section and which is located adjacent to and after the noise section.

9. The signal processing method according to claim 8, further comprising generating the past interpolation waveform by performing the time reversal on the first waveform and inverting signs of values of samples located before and after an end sample of the noise section when the signs of the values of the samples are different from each other, and generating the future interpolation waveform by performing the time reversal on the second waveform and inverting signs of values of samples located before and after an end sample of the noise section when the signs of the values of the samples are different from each other.

10. The signal processing method according to claim 5, further comprising:

determining, when the click noise is detected in a frame to be processed, that a starting position of the click noise corresponds to a position of a leading sample of one of the blocks which has a representative value equal to or smaller than a threshold value, wherein the representative value corresponds to one of representative values of a frame located immediately before the frame to be processed and which is located prior to and in a nearest position relative to one of the blocks which has the maximum representative value of the frame to be processed.

11. The signal processing method according to claim 5, further comprising: determining, when the click noise is detected in a frame to be processed, that a terminating position of the click noise corresponds to a position of a last sample of one of the blocks which has a representative value equal to or smaller than a threshold value, wherein the representative value corresponds to one of representative values of a frame located immediately after the frame to be processed and which is located prior to and in a nearest position relative to one of the blocks which has the maximum representative value of the frame to be processed.

12. The signal processing method according to claim 5, generating an adjacent interpolation waveform by performing cross-fade using a waveform of a section which has a predetermined length and which is located immediately before the noise section of the audio signal and a waveform of a section which has a predetermined length and which is located immediately before the section corresponding to the first waveform of the audio signal, and replacing a section adjacent to the noise section by the adjacent interpolation waveform.

13. The signal processing method according to claim 5, further comprising generating an adjacent interpolation waveform by performing cross-fade using a waveform of a section which has a predetermined length and which is located immediately after the noise section of the audio signal and a waveform of a section which has a predetermined length and which is located immediately after the section corresponding to the second waveform of the audio signal, and replacing sections adjacent to the noise section by the adjacent interpolation waveform.

14. A non-transitory computer-readable storage medium having stored thereon, a set of computer-executable instructions for causing a computer to perform steps comprising:

converting an audio signal into absolute values;

calculating representative values of consecutive sample values included in blocks of the audio signal, wherein the audio signal has been converted into the absolute values using at least a maximum sample value among the sample values included in the blocks;

determining a section comprising a predetermined number of consecutive blocks as a frame and calculating a maximum value of the representative values of the consecutive blocks included in the frame and an average value of the representative values of the consecutive blocks included in the frame;

detecting click noise in the frame based on a ratio of the maximum value of the representative values to the average value of the representative values;

and outputting the audio signal from which the detected click noise is removed.

15. A signal processing method comprising:

converting an audio signal into absolute values;

calculating representative values of consecutive sample values included in blocks of the audio signal, wherein the audio signal has been converted into the absolute values using at least a maximum sample value among the sample values included in the blocks;

determining a section comprising a predetermined number of consecutive blocks as a frame and calculate a maximum value of the representative values of the consecutive blocks included in the frame and an average value of the representative values of the consecutive blocks included in the frame, wherein the maximum sample value among the sample values included in the blocks corresponds to the representative values for individual blocks;

detecting click noise in the frame based on a ratio of the maximum value of the representative values to the average value of the representative values, wherein the click noise in a frame to be processed is detected using the maximum value of the representative values and the average value of the representative values of the frame to be processed and maximum values of the representative values and average values of the representative values of other frames located in the vicinity of the frame to be processed; and outputting the audio signal from which the detected click noise is removed.

* * * * *